US011285396B2

(12) United States Patent
Hunter et al.

(10) Patent No.: US 11,285,396 B2
(45) Date of Patent: Mar. 29, 2022

(54) SPRAY NOZZLE FOR WATER SLIDE FEATURE

(71) Applicant: PROSLIDE TECHNOLOGY INC., Ottawa (CA)

(72) Inventors: Richard D. Hunter, Ottawa (CA); Raymond T. Smegal, Ottawa (CA)

(73) Assignee: ProSlide Technology Inc., Ottawa (CA)

( * ) Notice: Subject to any disclaimer, the term of this patent is extended or adjusted under 35 U.S.C. 154(b) by 0 days.

(21) Appl. No.: 17/052,596

(22) PCT Filed: May 17, 2019

(86) PCT No.: PCT/CA2019/050678
§ 371 (c)(1),
(2) Date: Nov. 3, 2020

(87) PCT Pub. No.: WO2019/218083
PCT Pub. Date: Nov. 21, 2019

(65) Prior Publication Data

US 2021/0236945 A1 Aug. 5, 2021

Related U.S. Application Data

(60) Provisional application No. 62/673,553, filed on May 18, 2018.

(51) Int. Cl.
*A63G 21/18* (2006.01)
*B05B 15/68* (2018.01)

(52) U.S. Cl.
CPC ..... *A63G 21/18* (2013.01); *B05B 15/68* (2018.02)

(58) Field of Classification Search
CPC ..... A63G 21/00; A63G 21/18; B05B 1/02; B05B 15/06; B05B 15/10
(Continued)

(56) References Cited

U.S. PATENT DOCUMENTS 5,383,600 A * 1/1995 Verbera ..... B05B 3/0431 239/205
5,503,597 A 4/1996 Lochtefeld et al.
(Continued)

FOREIGN PATENT DOCUMENTS

WO WO 2015/161382 A1 10/2015

OTHER PUBLICATIONS

International Search Report and Written Opinion of the International Searching Authority, issued from the Canadian Intellectual Property Office for corresponding PCT/CA2019/050678, dated Aug. 27, 2019 (12 pages).

*Primary Examiner* — Kien T Nguyen
(74) *Attorney, Agent, or Firm* — Finnegan, Henderson, Farabow, Garrett & Dunner, L.L.P.

(57) ABSTRACT

A spray nozzle for use in a water slide feature is disclosed. The nozzle includes a nozzle body with a connection portion for connecting to a fluid supply and a support portion for affixing to a support structure. The nozzle further includes a nozzle tip removably connected to the nozzle body. The nozzle tip is prevented from being removed from the nozzle body by at least a releasable lock. The lock includes a member movable to release the lock, the member being accessible to a user from an exterior of the nozzle. Also disclosed is a nozzle with a tip portion having a passageway with three curved portions with different radii of curvature.

39 Claims, 18 Drawing Sheets

(58) Field of Classification Search
USPC ..... 472/117, 128
See application file for complete search history.

(56) References Cited

U.S. PATENT DOCUMENTS

| | | | | |
|---|---|---|---|---|
| 5,810,262 | A | 9/1998 | Ton | |
| 5,881,958 | A | 3/1999 | Asakawa et al. | |
| 7,726,587 | B2 * | 6/2010 | Markley | B05B 1/34 239/247 |
| 8,458,825 | B2 | 6/2013 | Peng et al. | |
| 8,888,023 | B2 | 11/2014 | Barton | |
| 2016/0114347 | A1 | 4/2016 | Kossarnig | |
| 2016/0136527 | A1 * | 5/2016 | Hunter | A63G 21/18 472/88 |

* cited by examiner

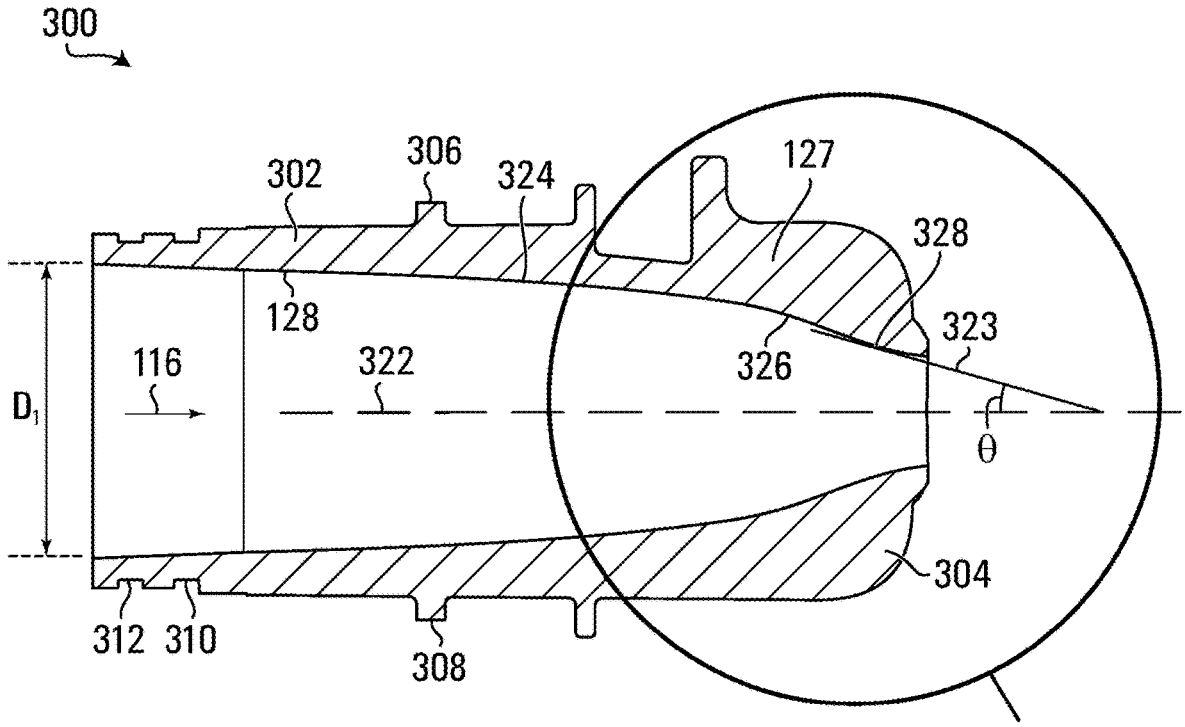
FIG. 26
FIG. 25
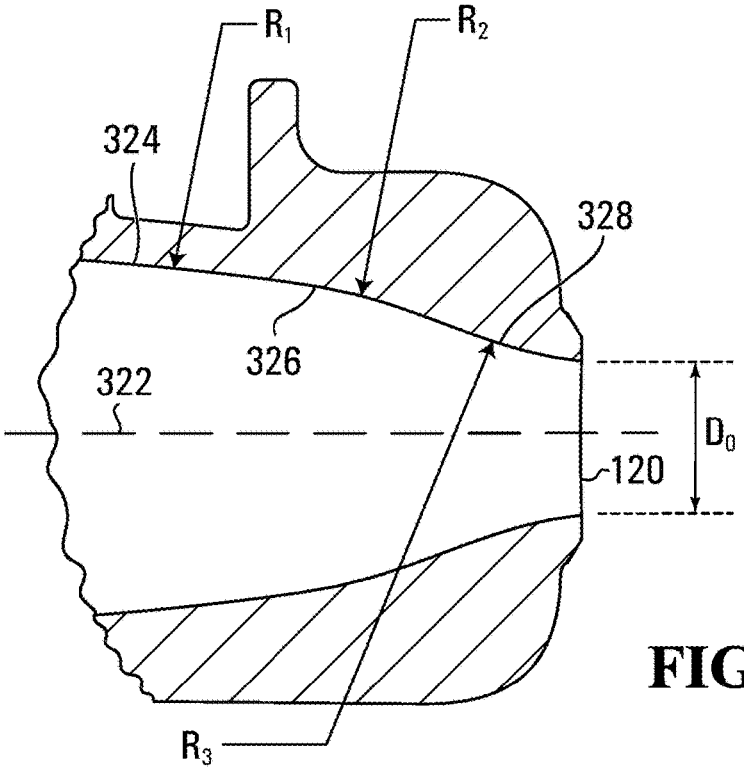
FIG. 26

SPRAY NOZZLE FOR WATER SLIDE FEATURE

FIELD

The present disclosure relates generally to spray nozzles. In particular, the present disclosure relates to spray nozzles for use in amusement attractions, such as water amusement attractions including water slide features.

BACKGROUND

In the past few decades, amusement attractions have become increasingly popular. In many such attractions, water is sprayed as part of the attraction. In water slide type attractions, water may be sprayed over a sliding surface to lubricate the surface and/or impart movement to or affect motion of riders or ride vehicles in the slide. Spray nozzles may also be used to create visual or tactile effects. Spray nozzles may also be used as part of play structures, for example at the end of water cannons or other devices with which participants can spray each other.

Water amusement attractions, however, often require large volumes of water to operate and utilize significant energy reserves to move the water throughout the attraction. Water consumption may also be a concern, particularly in arid countries. Moreover, installation and maintenance of spray nozzles may pose operational and logistical difficulties.

SUMMARY

In one aspect of the present disclosure, there is provided a water slide feature comprising: a channel have a sliding surface for a rider or a ride vehicle to slide on, and one or more nozzles positioned to spray fluid into the channel to affect motion of the rider or ride vehicle, at least one of the one or more nozzles comprising: a nozzle body including a connection portion for connecting to a fluid supply of the fluid and a support portion for affixing to a support structure of the water slide feature; and a nozzle tip removably connected to the nozzle body, the nozzle tip being prevented from being removed from the nozzle body by at least a releasable lock, wherein the lock comprises a member movable to release the lock, the member being accessible to a user from an exterior of the nozzle.

In another aspect of the present disclosure, there is provided A water slide feature comprising: a channel have a sliding surface for a rider or a ride vehicle to slide on, and one or more nozzles positioned to spray water into the channel to affect motion of the rider or ride vehicle, at least one of the one or more nozzles comprising: a nozzle inlet; a nozzle outlet; and a passageway wall with an interior surface defining a passageway for the water to flow from the nozzle inlet to the nozzle outlet, wherein, in a tip portion of the nozzle, the interior surface extends circumferentially around a central axis and comprises: a first curved portion with a first radius of curvature, an angle between the interior surface and the central axis increasing along the first curved portion, a second curved portion with a second radius of curvature, the second curved portion being immediately downstream of the first curved portion, the angle between the interior surface and the central axis increasing along the second curved portion, and a third curved portion with a third radius of curvature, the third curved portion being immediately downstream of the second curved portion, the angle between the interior surface and the central axis decreasing along the second curved portion.

Other aspects and features of embodiments of the present disclosure will become apparent to those ordinarily skilled in the art upon review of the following description.

BRIEF DESCRIPTION OF THE DRAWINGS

Examples of embodiments according to the present disclosure will now be described in greater detail with reference to the accompanying drawings, in which:

FIG. 25 is a cross-sectional view thereof as shown in FIG. 24;

FIG. 26 is an enlarged view of the portion indicated in FIG. 25;

DETAILED DESCRIPTION

In one aspect of the present disclosure, a nozzle for use in a water slide feature includes a nozzle body and a nozzle tip removably connected to the nozzle body. The nozzle tip is prevented from being removed from the nozzle body by at least a releasable lock. The lock includes a member movable to release the lock, the member being accessible to a user from an exterior of the nozzle.

Referring to FIGS. 1 to 8, embodiments of a nozzle according to the present disclosure will now be described.

Figure 1:
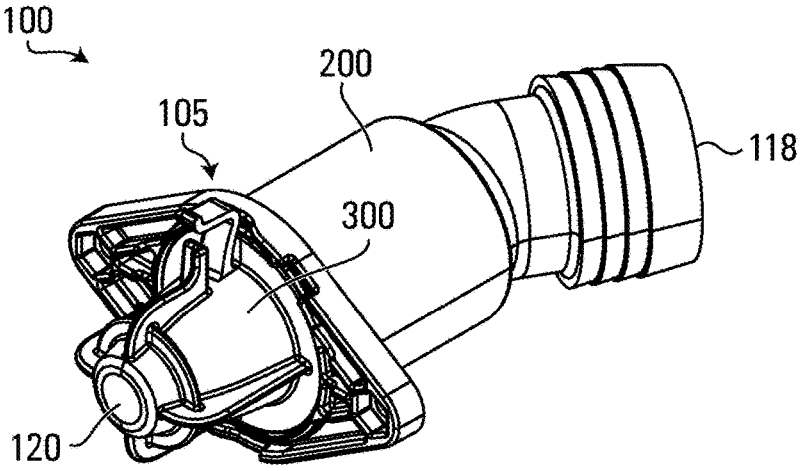
FIG. 1 is a perspective view of a spray nozzle according to one embodiment of the present disclosure.
Figure 2:
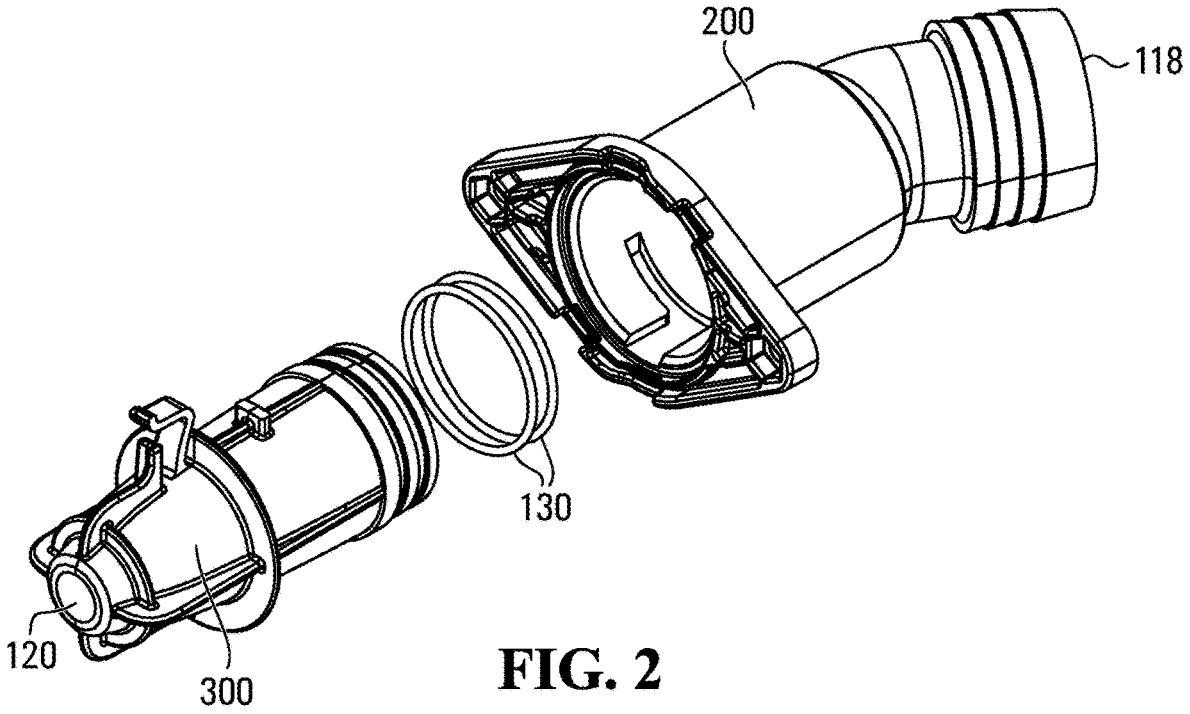
FIG. 2 is a exploded view thereof.
Figure 3:
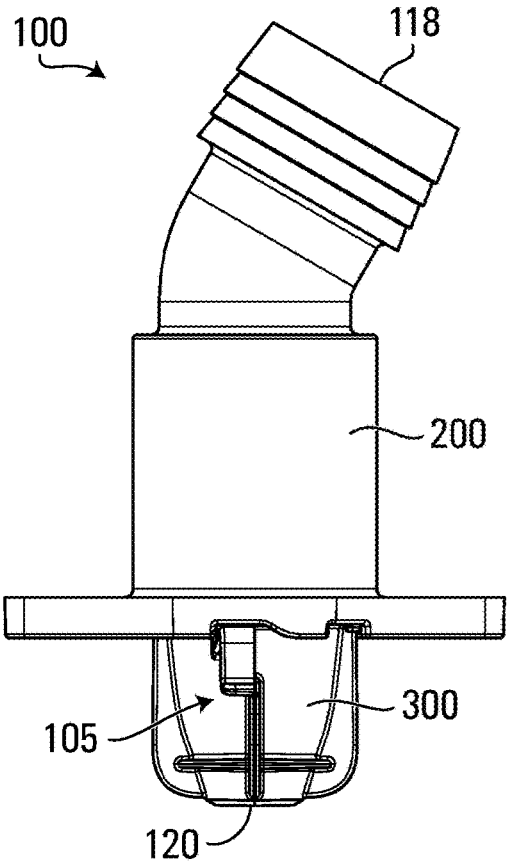
FIG. 3 is a top view thereof.
Figure 4:
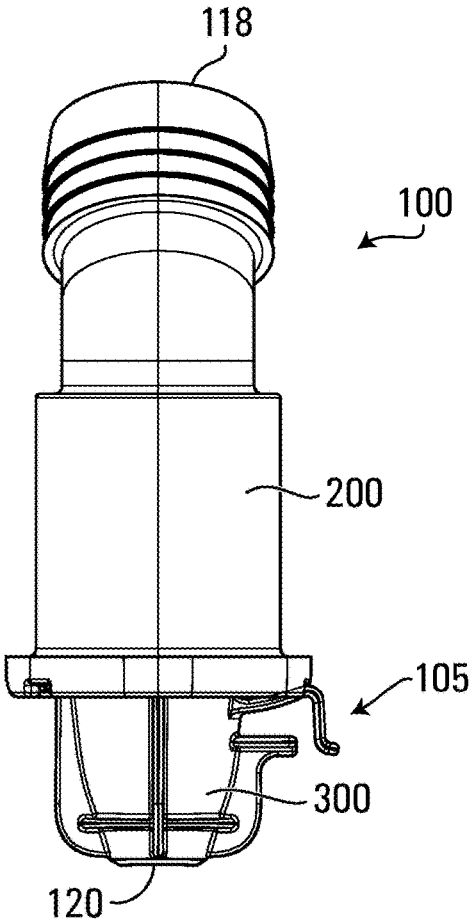
FIG. 4 is a side view thereof.
Figure 5:
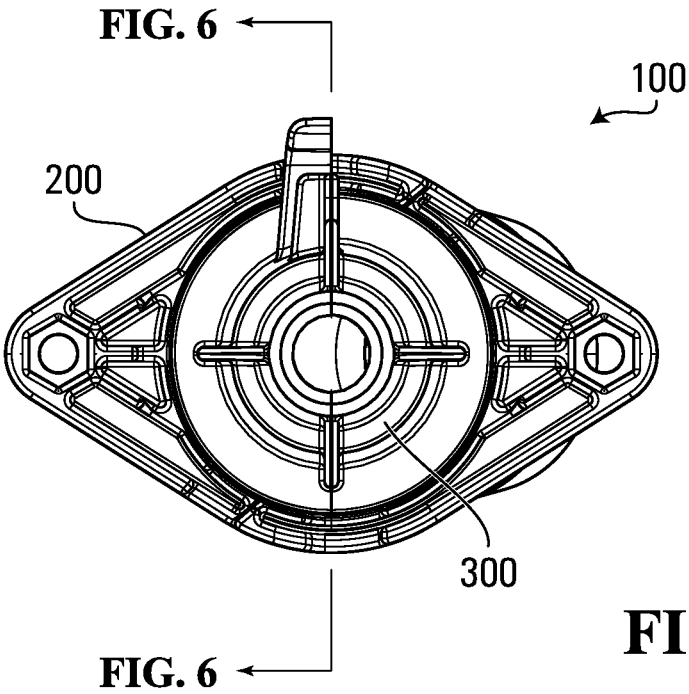
FIG. 5 is a front view thereof.
Figure 6:
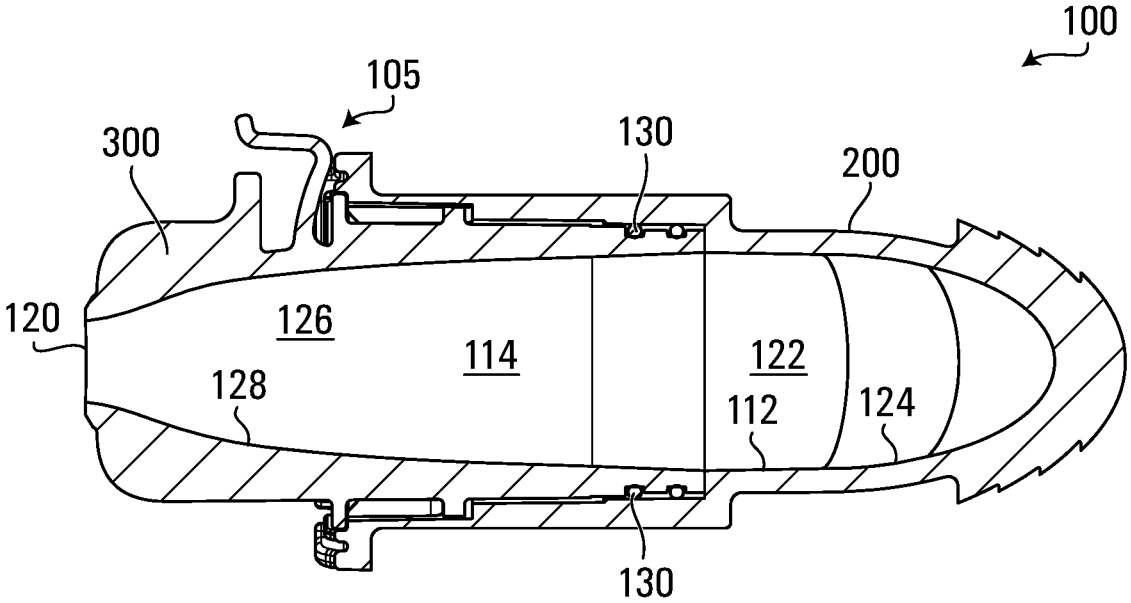
FIG. 6 is a cross-sectional view thereof as shown in FIG. 5.
Figure 7:
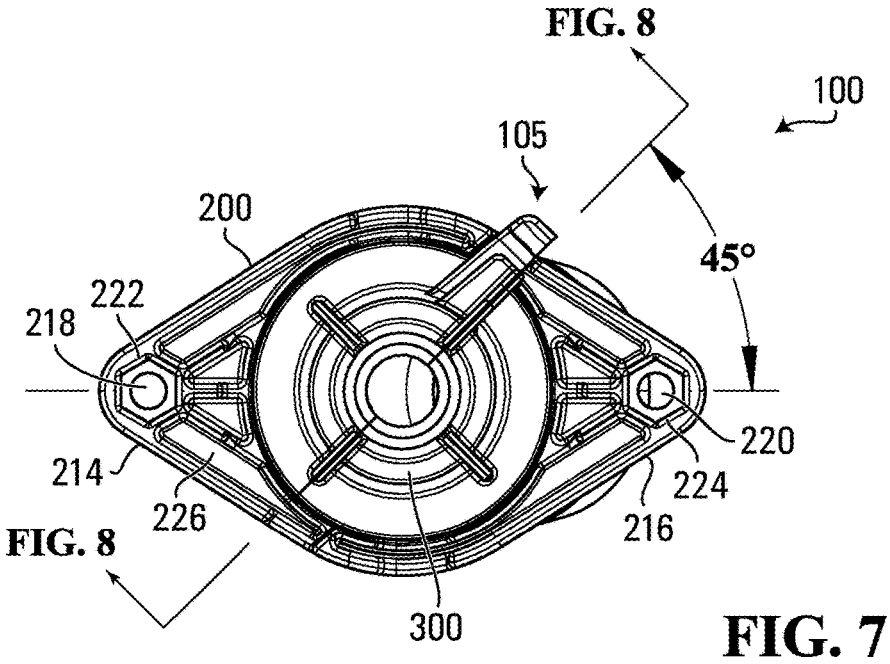
FIG. 7 is a front view thereof in locked position.

FIG. 1 shows a nozzle 100 comprising a nozzle body 200 and a nozzle tip 300. The nozzle tip 300 is insertable into the nozzle body 200 in a specific orientation until it reaches an inserted position as shown in FIG. 1 and is then rotatable into a locked position, as shown in FIG. 7. In the locked position, a lock, generally shown at 105, prevents the nozzle tip 300 from being removed from the nozzle body 200.

Figure 8:
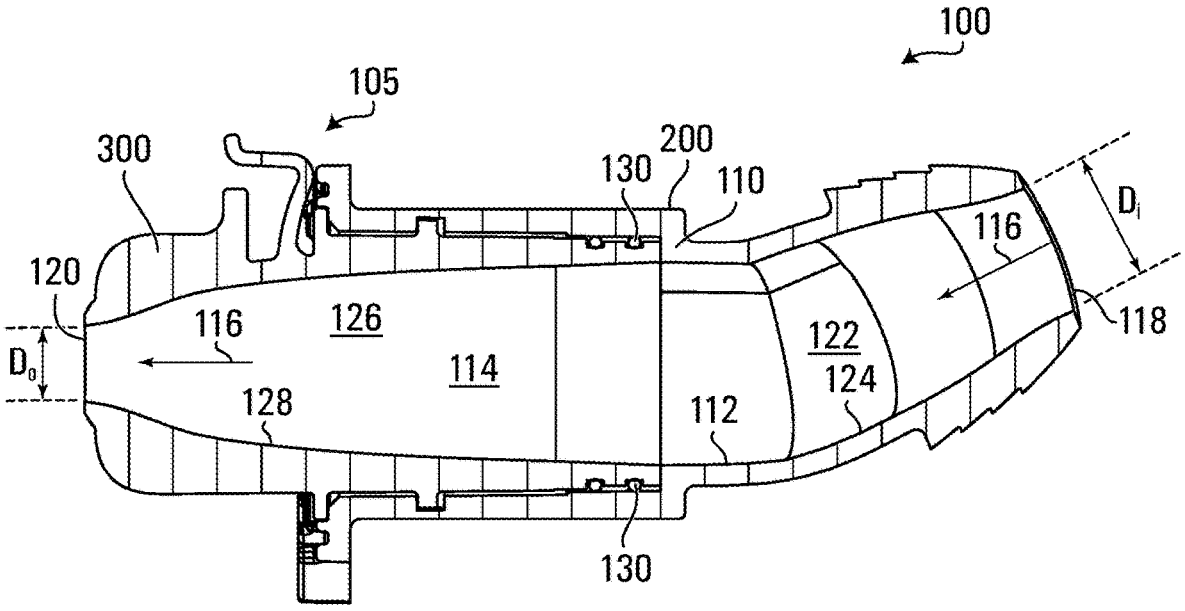
FIG. 8 is a cross-sectional view thereof as shown in FIG. 7.
Figure 9:
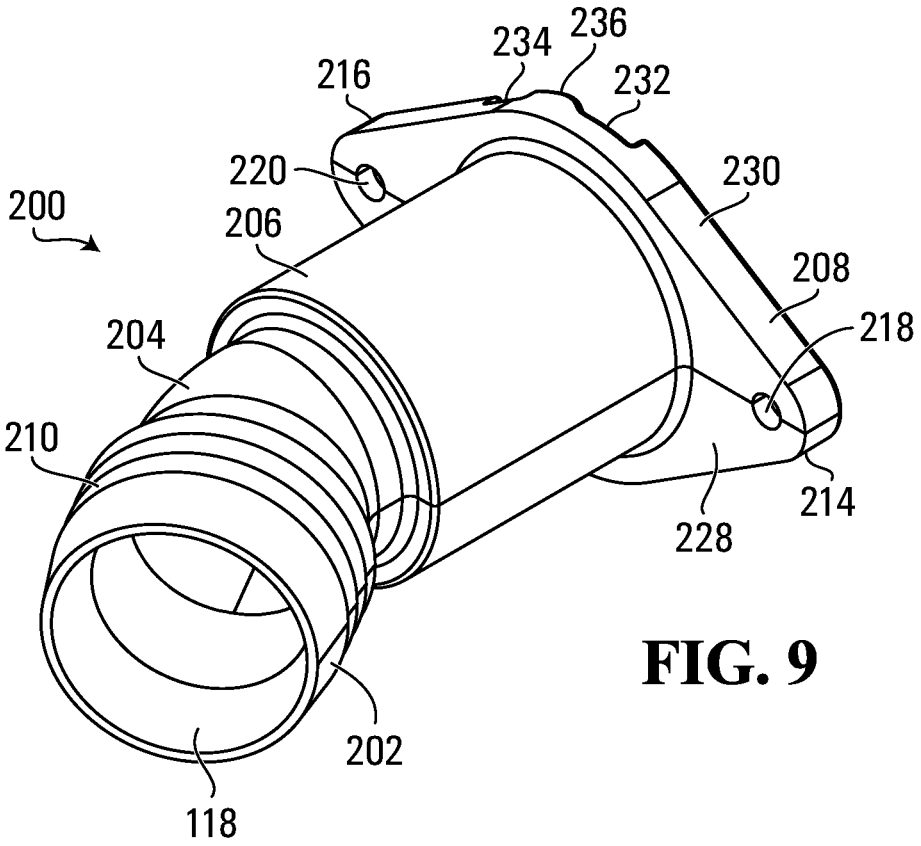
FIG. 9 is a rear perspective view of the nozzle body of the nozzle of FIG. 1.
Figure 10:
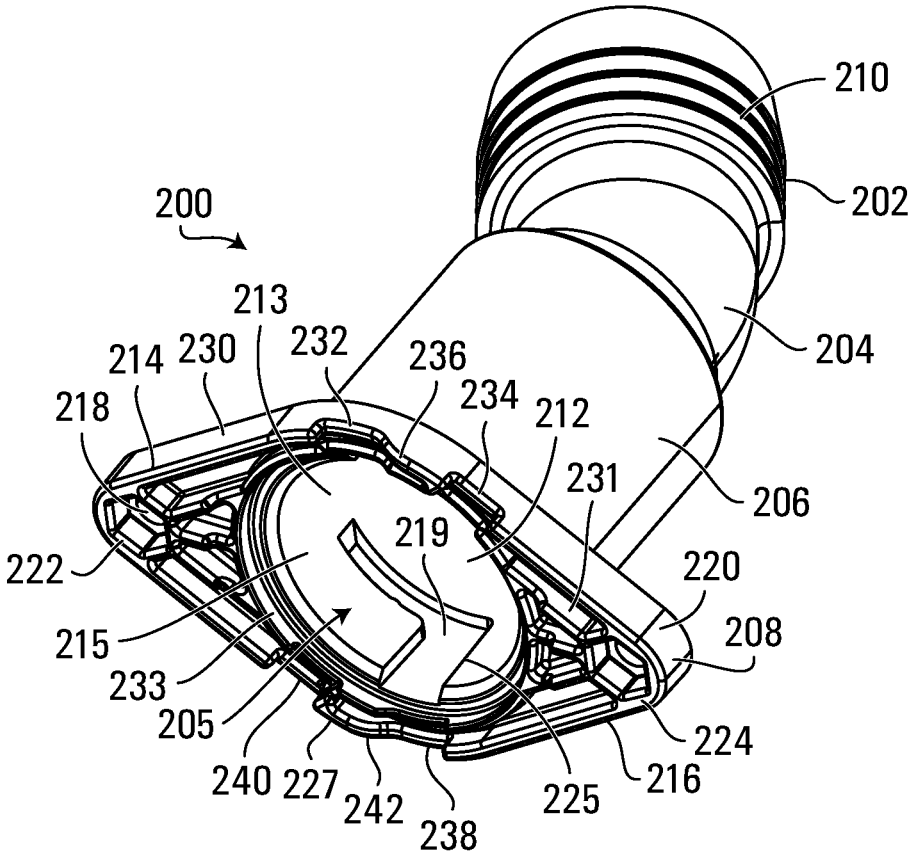
FIG. 10 is a front perspective view thereof.

As best seen in FIG. 8 the nozzle 100 includes a wall 110 with an interior surface 112 defining a passageway 114 for the liquid to flow through in a flow direction 116 from an inlet 118 with an inlet diameter $D_i$ to an outlet 120 with an outlet diameter $D_o$. The passageway may be divided into a body passageway 122 with a body interior surface 124 that extends through the nozzle body 200 and a tip passageway 126 with a tip interior surface 128 that extends through the nozzle tip 300.

In the embodiment shown, the body passageway 122 and tip passageway 126 are sized and configured so that, at least in the locked position, the body interior surface 124 is substantially flush with the tip interior surface 128 where the body passageway 122 and the tip passageway 126 meet. This results in a substantially continuous interior surface 112 at the meeting point and avoids a step change that might cause unwanted turbulence or pressure changes in the flow of fluid through the nozzle. However, this continuous interior surface at the meeting point between the nozzle body 200 and nozzle tip 300 is not necessarily present in all embodiments, for example due to manufacturing tolerances.

The nozzle 100 may also include O-rings 130 for providing a seal between nozzle tip 300 and nozzle body 200.

Referring to FIGS. 9 to 18, the embodiment of the nozzle body 200 shown in FIGS. 1 to 8 will now be described in more detail. The nozzle body 200 includes a connection portion 202, an elbow 204, an engagement portion 206, and a support portion 208.

The connection portion 202 is for connecting the nozzle body 200 to a supply of fluid (not shown) such as a supply of liquid, for example water. In the embodiment shown, the connection portion 202 includes a hose barb 210. A hose can be slid onto the hose barb 210 and held in place using known means, such as a worm gear clamp. However, in other embodiments, the connection portion 202 may include other known structures or mechanisms for connecting a hose or other fluid supply conduit. For example, the connection portion 202 may include a threaded connection or a simple slide-on connection. Other connections could include quick disconnects or couplings.

Figure 11:
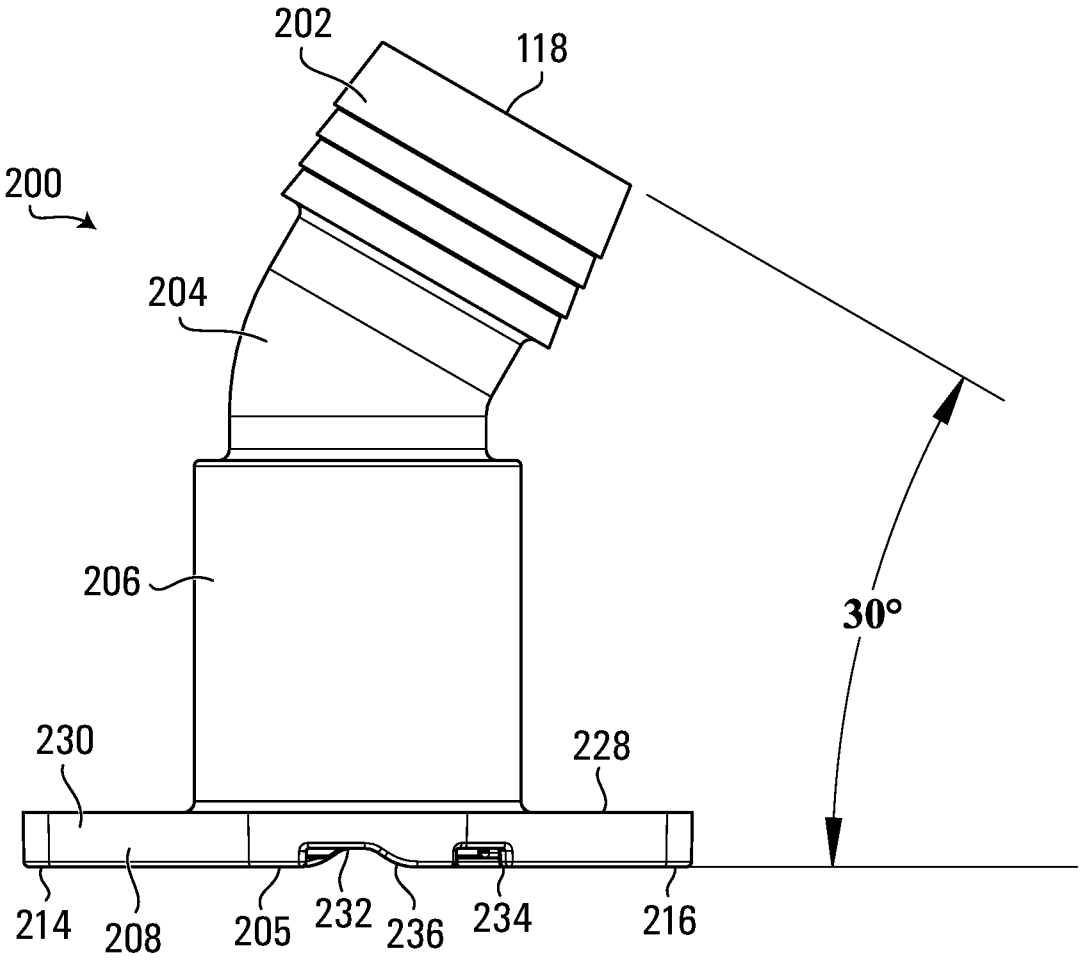
FIG. 11 is a top view thereof.
Figure 12:
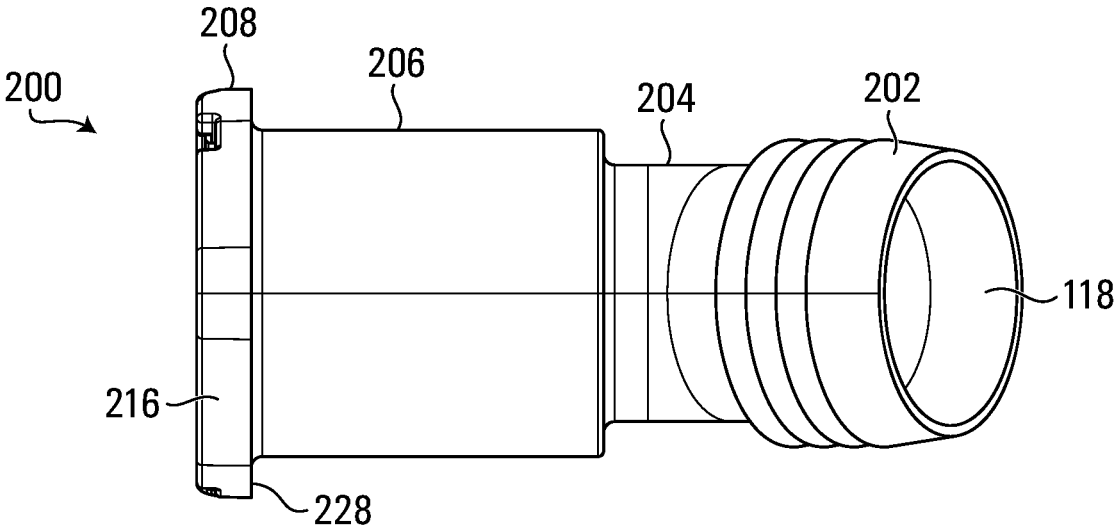
FIG. 12 is a right side view thereof.
Figure 13:
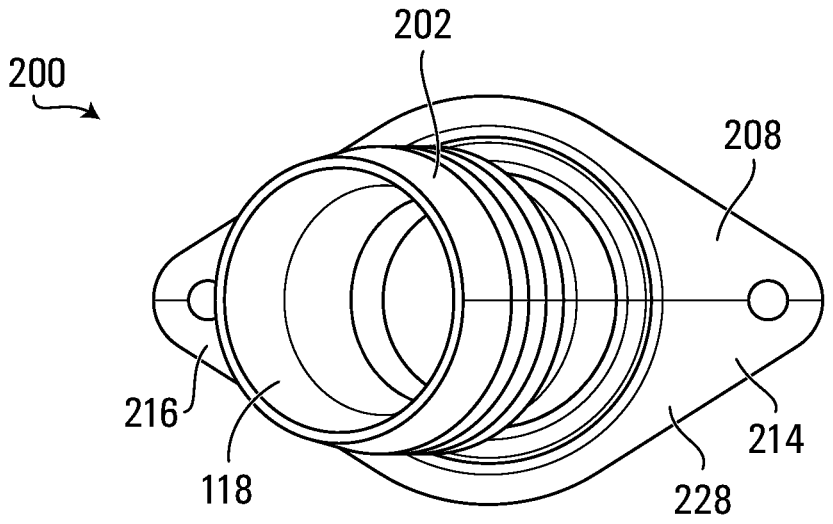
FIG. 13 is a rear view thereof.
Figure 14:
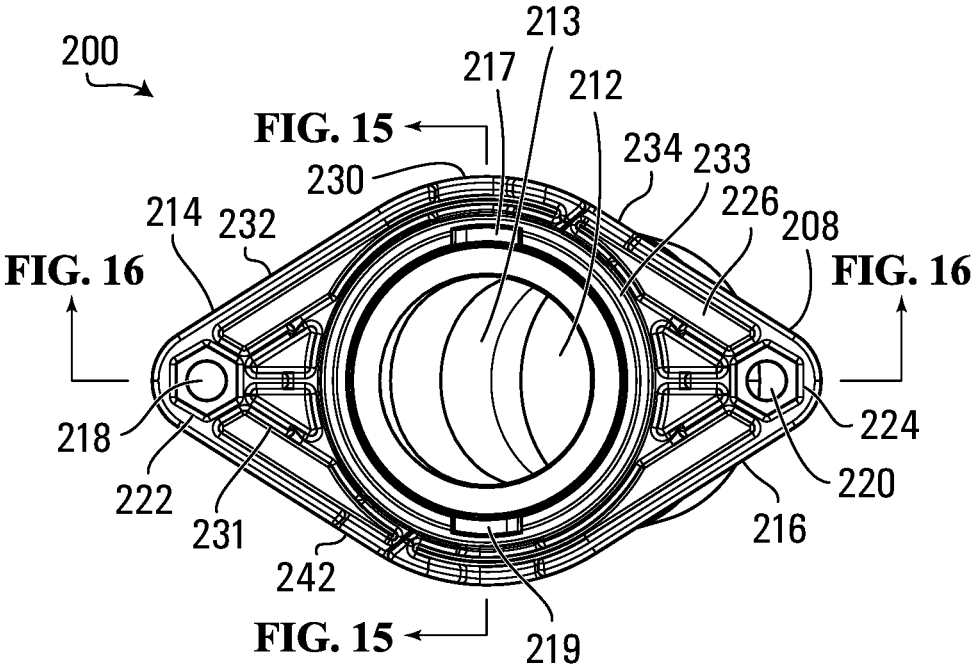
FIG. 14 is a front view thereof.
Figure 15:
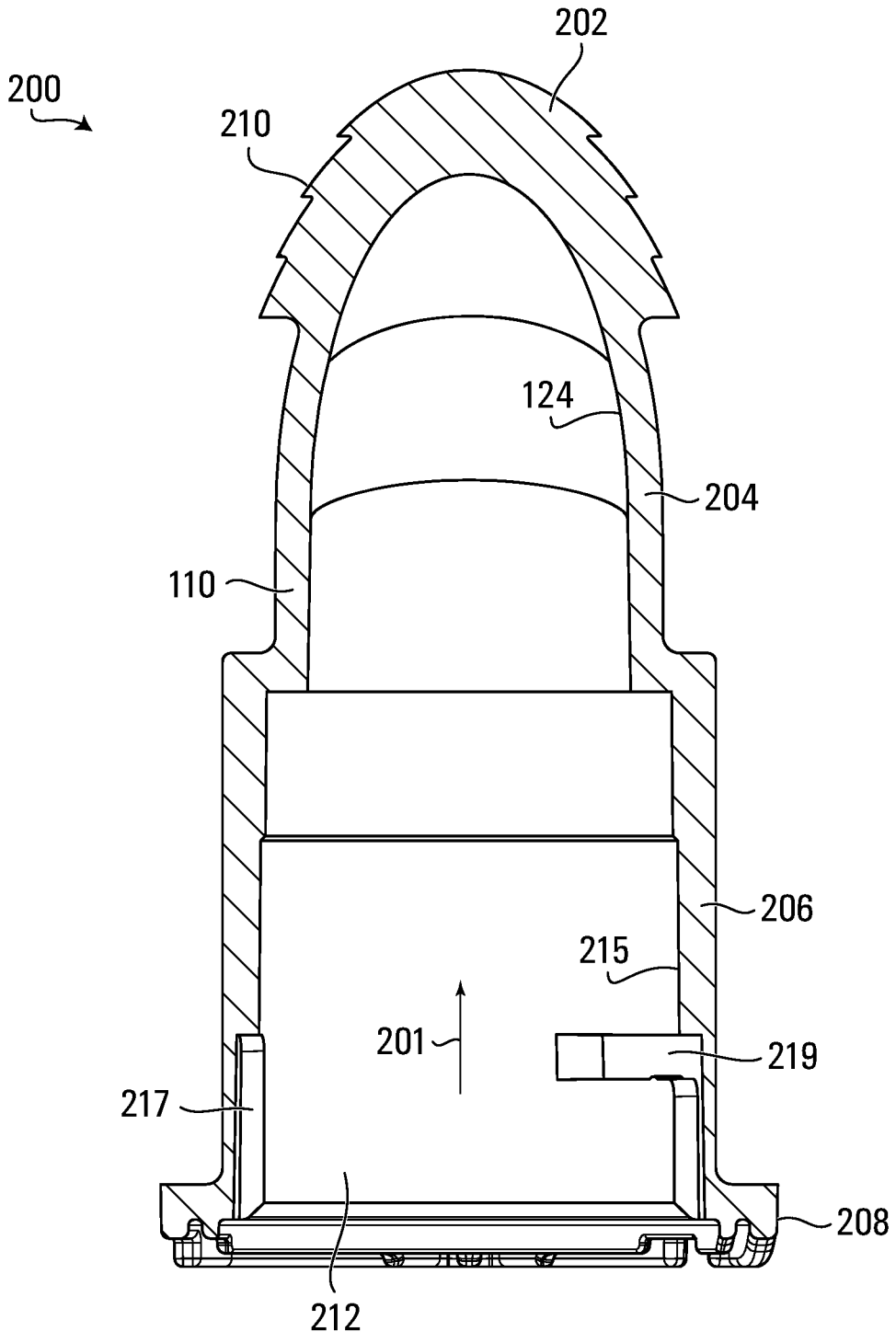
FIG. 15 is a cross-sectional view thereof as shown in FIG. 14.
Figure 16:
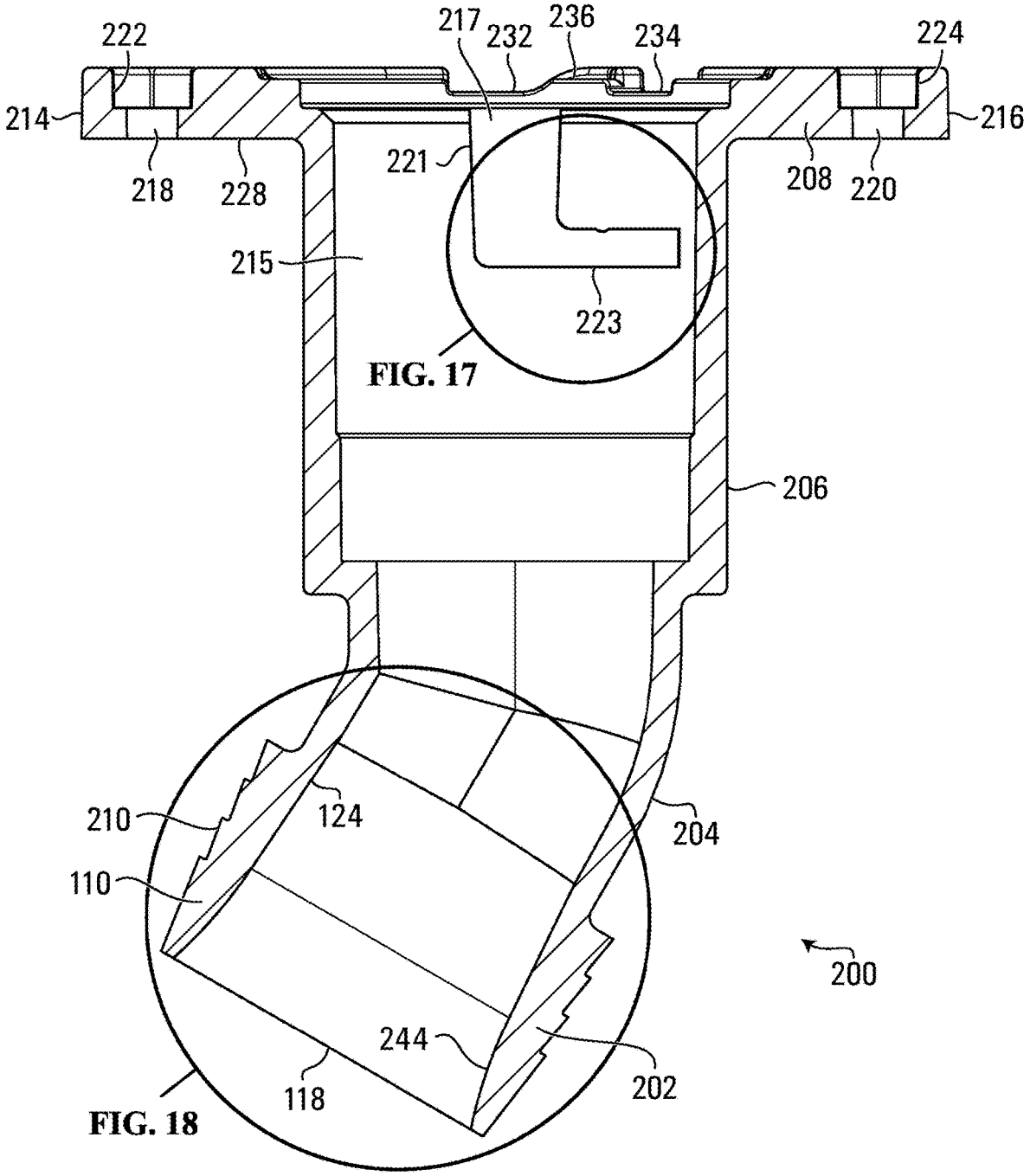
FIG. 16 is a cross-sectional view thereof as shown in FIG. 14.

In the embodiment shown, the elbow 204 creates a 30 degree bend in the nozzle body. That is, as shown in FIG. 11, an angle between the inlet 118 and an exit 205 of the nozzle body 200 is 30 degrees.

However, in other embodiments, other angles are possible. The elbow may create a bend anywhere between 1 and 90 degrees. There may also be no bend present at all. In some embodiments, the elbow may be omitted and the connection portion may extend directly from the engagement portion. In yet other embodiments, one or more other intermediate portions may be present between the connection portion and the engagement portion.

In the embodiment shown, the engagement portion 206 generally extends from the end of elbow 204. The engagement portion has a generally cylindrical shape and includes a socket 212 for receiving the nozzle tip 300.

Socket 212 includes a socket opening 213 and an interior socket surface 215. The socket surface 215 is generally cylindrical, extending in a longitudinal direction 201 and ends where the wall 110 extends into the nozzle body 200.

Two grooves or channels 217, 219 are formed in the socket surface 215 180 degrees apart. Groove 217 is generally L-shaped and includes two groove sections: a longitudinal section 221 that extends in a longitudinal direction from the socket opening 213 and a circumferential section 223 that extends at a 90 degree angle from the longitudinal section 221 in a circumferential direction along the socket surface 215. Groove 219 is similarly configured with a longitudinal section 225 and a circumferential section 227. Circumferential section 227 extends in the same direction as circumferential section 223. In the embodiment shown, both circumferential sections 223, 227 extend clockwise.

Figure 17:
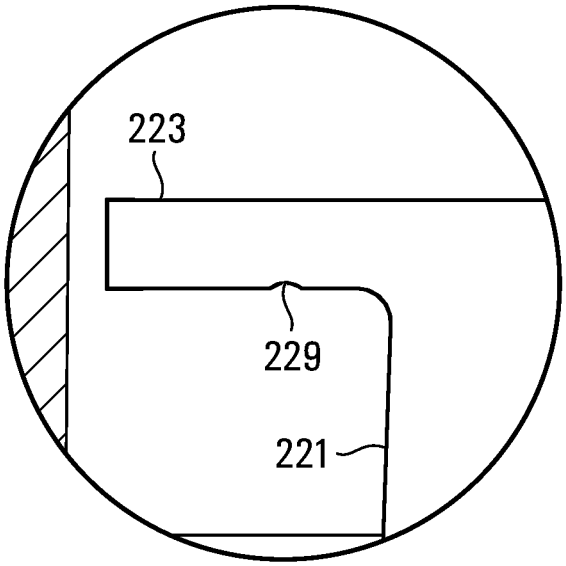
FIG. 17 is an enlarged view of the portion indicated in FIG. 16.
Figure 18:
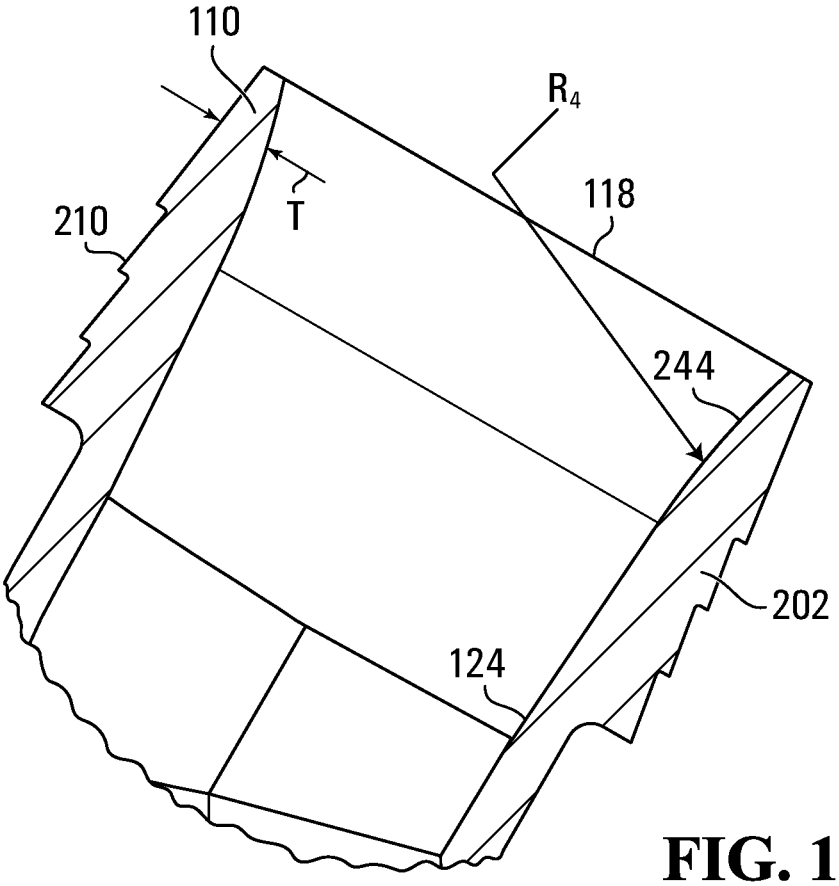
FIG. 18 is an enlarged view of the portion indicated in FIG. 16.
Figure 19:
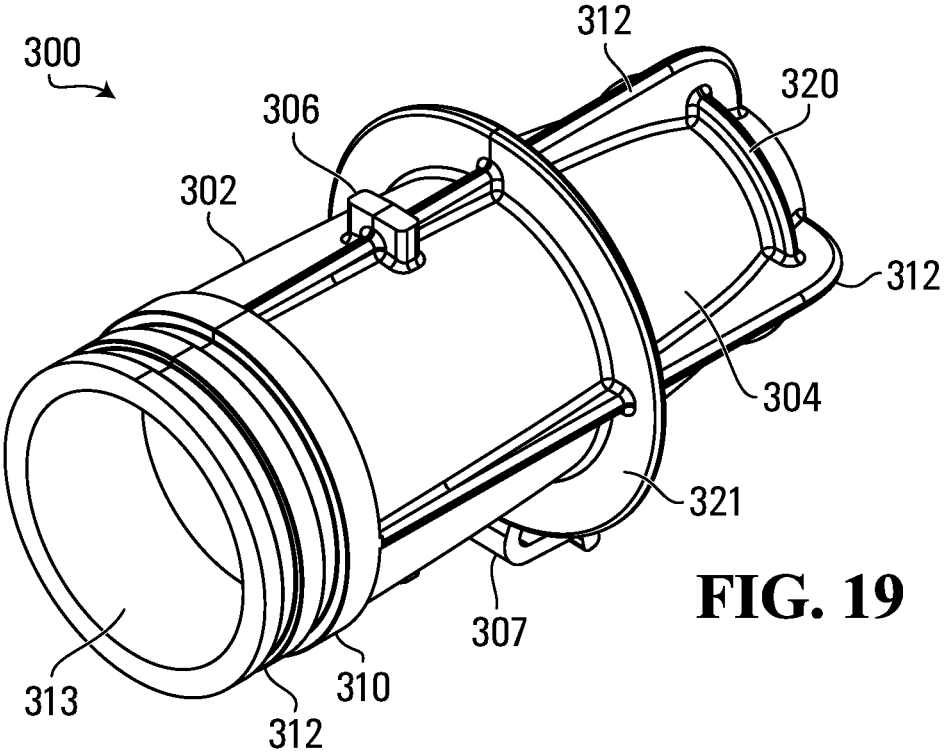
FIG. 19 is a rear perspective view of the nozzle tip of the nozzle of FIG. 1.
Figure 20:
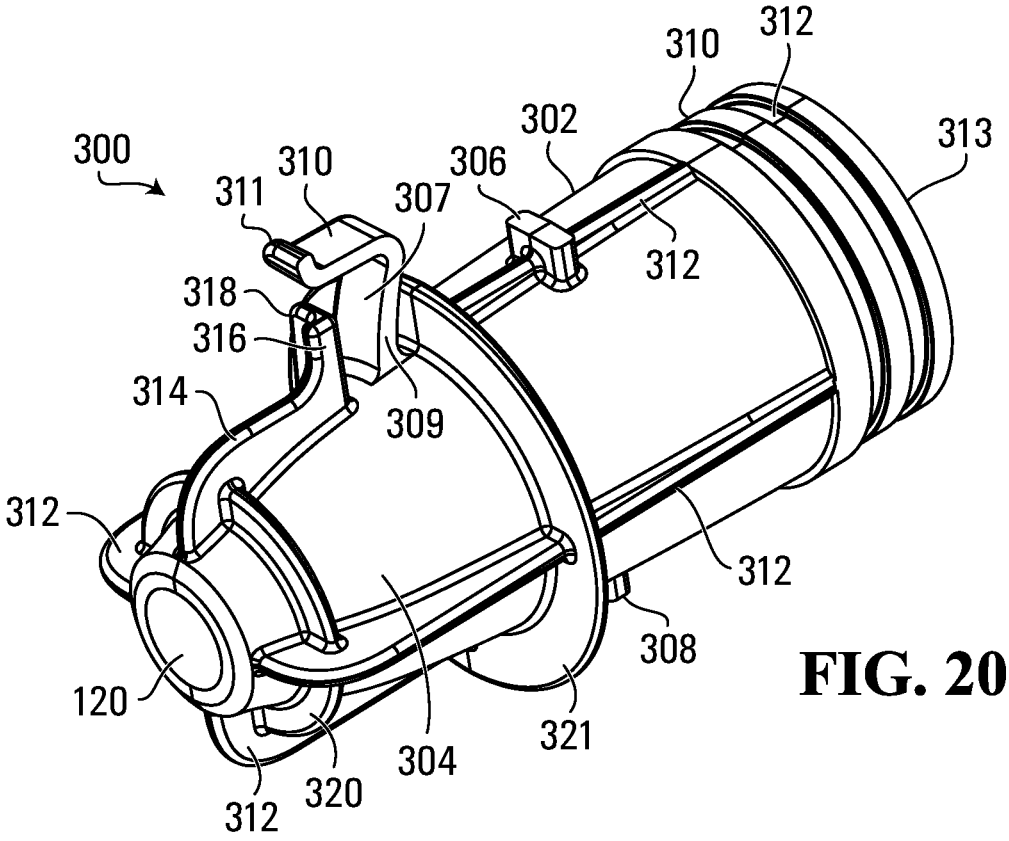
FIG. 20 is a front perspective view thereof.
Figure 21:
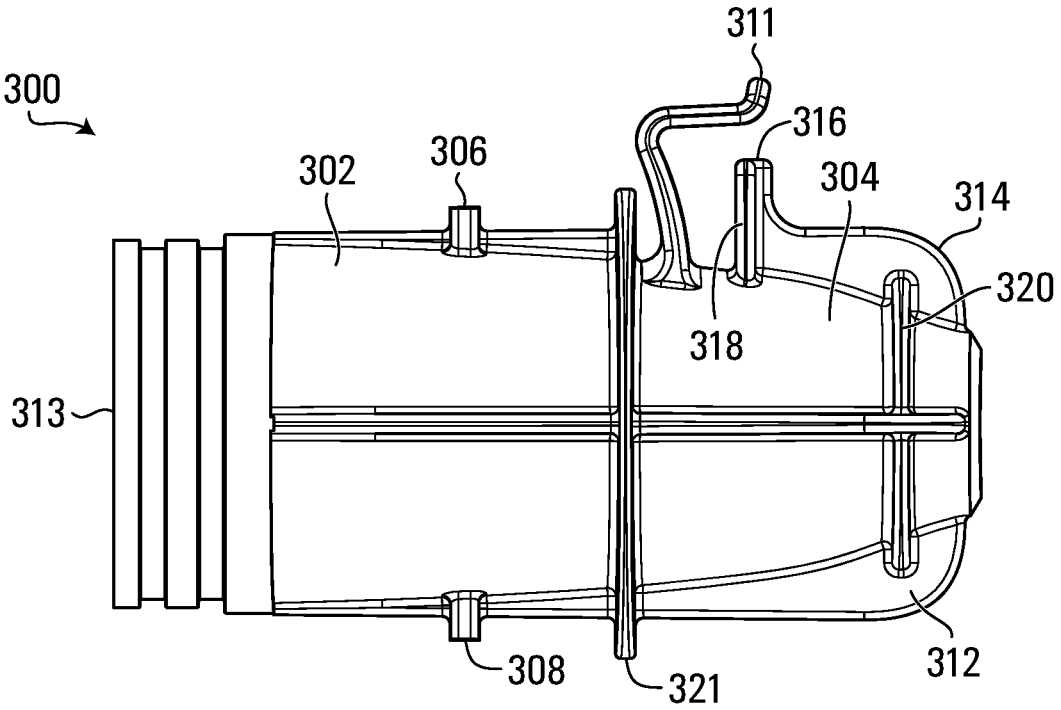
FIG. 21 is a left side view thereof.
Figure 22:
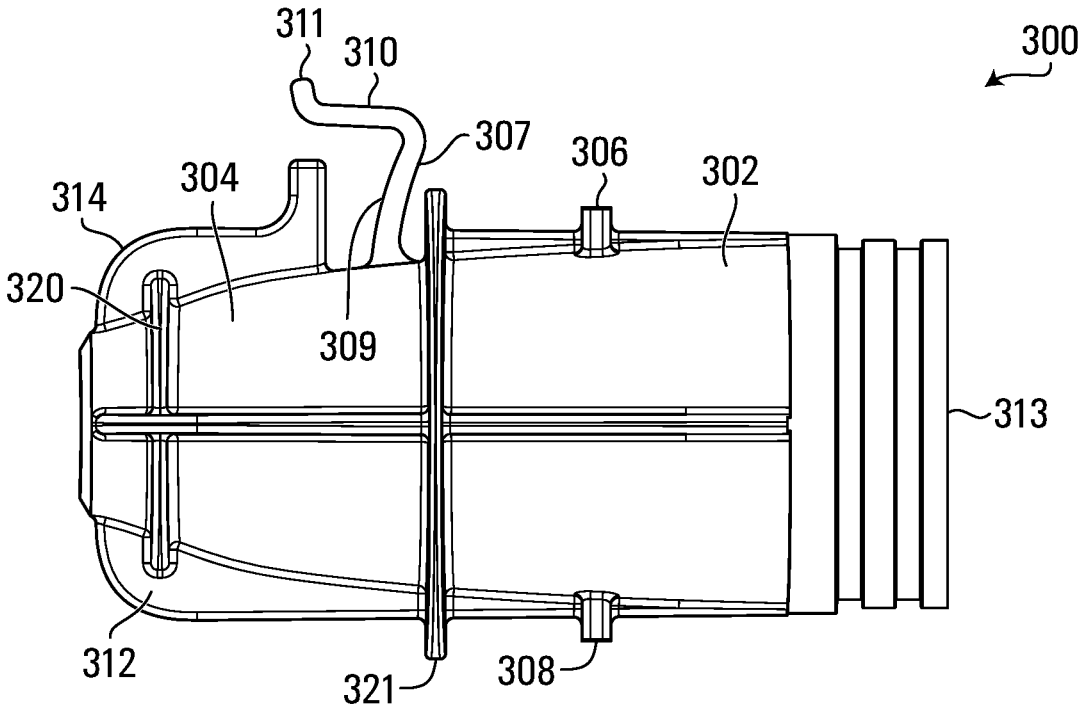
FIG. 22 is a right side view thereof.
Figure 23:
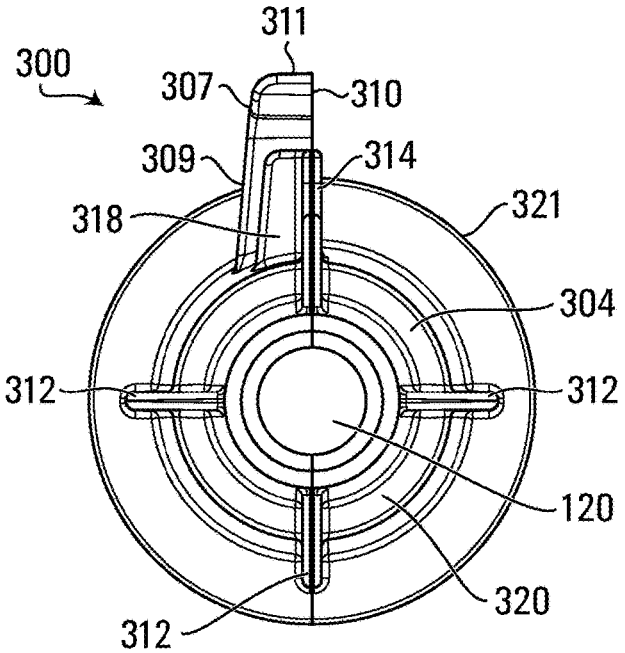
FIG. 23 is a front view thereof.
Figure 24:
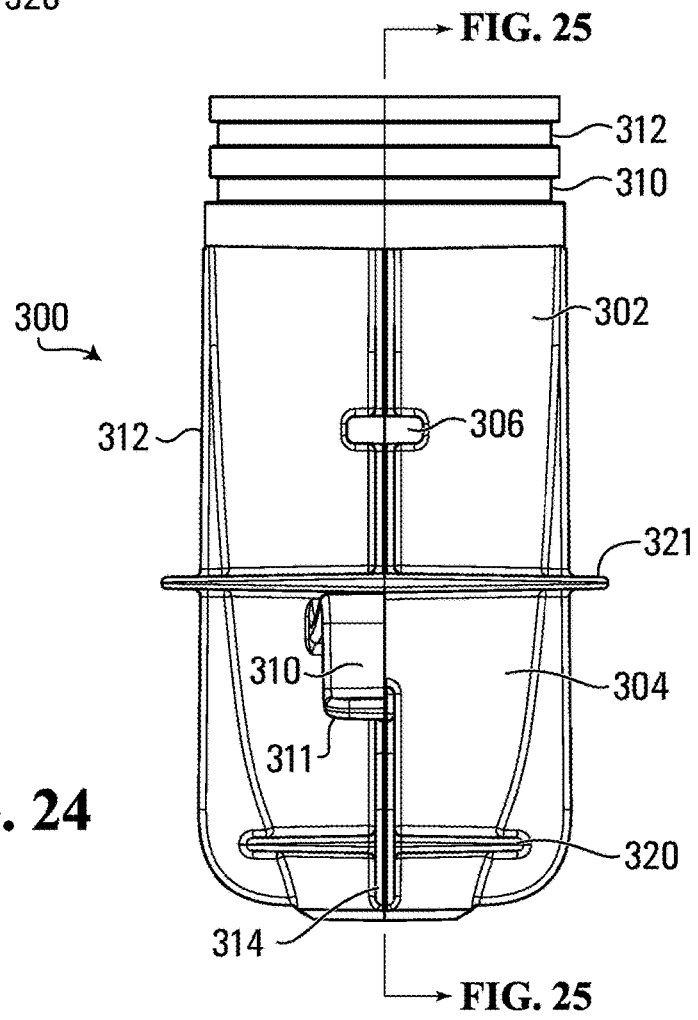
FIG. 24 is a top view thereof.

As best seen in FIG. 17, the circumferential section 223 includes a rounded protrusion or nub 229 that extends into the circumferential section 223 and results in a constriction of the circumferential section 223. A substantially similar nub is present in circumferential section 227.

Other embodiments and configuration for the engagement portion may also be possible. For example, the engagement portion of the nozzle body may comprise a protrusion for being received in a corresponding socket in the nozzle tip. The engagement portion may also include a combination of recesses and protrusions for engaging with the nozzle tip. More generally, engagement between the nozzle body and the nozzle tip may encompass a variety of structural arrangements, such as complementary or mating structures, that permit engagement and assembly of the nozzle body with the nozzle tip in such a way as to provide that the body passageway and the tip passageway communicate with each other in the assembled nozzle.

Similarly, in some embodiments, other configurations of the grooves 217, 219 may be possible. For example, the grooves may extend through the engagement portion, creating apertures. There may only be a single groove or more than two. The grooves may also take on different shapes or paths.

As discussed further below, the grooves form part of complementary retaining structures that cooperate with corresponding structures on the nozzle tip to help retain the nozzle tip in a desired position. Accordingly, the configurations of the grooves, if present, will be complementary to the configuration of the retaining structures on the nozzle tip and vice versa.

Support portion 208 is integrally connected to the engagement portion 206 at an end of the nozzle body 200 opposite the inlet 118. The support portion 208 includes two wings 214, 216 that extend from either side of engagement portion 206. The wings 214, 216 include bores 218 and 220, respectively, for receiving a fastener (not shown) for affixing each of the wings 214, 216—and thus support portion 208—to a support structure, for example to the support structure of a water slide feature, as discussed below.

The bores 218, 220 are recessed in hexagonally shaped recesses 222, 224. These recesses are sized and configured to be complementary to the shape of the fasteners used to affix the wings 214, 216 and aid in preventing the fastener from loosening during use of the nozzle 100.

The support portion 208 includes a front face 226 and a rear face 228, with a rim 230 extending from the front face 226 and around the perimeter of the support portion 208. A plurality of ribs 231 are provided on the front face 226, providing additional strength to the support portion 208.

A circular rib 233 also extends from the front face 226 and concentrically around socket opening 213.

In the embodiment shown, the rim 230 includes two holders 232, 234 spaced apart from each other along the perimeter of the rim 230. A partially ramped protrusion 236 extends from the rim 230 between the holders 232, 234. Substantially similar holders 238, 240 and ramped protrusion 242 are arranged on the bottom of the rim 230 at 180 degrees from the holders 232, 234 and ramped protrusion 236.

Holder 234 and ramped protrusion 236 are part of the lock 105 and cooperate with corresponding locking features on the nozzle tip 300 to prevent the nozzle tip from being removed from the nozzle body 200, as will be discussed further below.

Other embodiments and configurations of the support portion are possible. For example, there may be only a single wing. The wing or wings may have a different shape and configuration, may not extend from the same portion of the nozzle body, and/or may be affixed to the support structure in a different manner. In general, the support portion may itself not be integral with the nozzle body and may be permanently or removably affixed to the nozzle body before being used to affix the nozzle body to the support structure.

Specifically, other embodiments and configurations of the rim are also possible. The rim may not be present at all or take on a different or partial shape around the perimeter of the support portion. The holder and the ramp that form part of the lock need not be arranged on the rim. For example, in embodiments where the engagement portion includes a protrusion that is received in the nozzle tip, the holders and ramp may be positioned on the protrusion or another part of the nozzle body extending from the protrusion. In embodiments where the engagement portions extends and is received in the nozzle tip, the elements as shown in the depicted embodiments may be reversed with the grooves, holder, and ramp on the nozzle tip and corresponding protrusions on the nozzle body.

In the embodiment shown, the holders are formed as indentations. Other embodiments are possible. The holder may be an aperture that receives a spring-loaded detent. The holder may also be formed as an indentation with a partial cover covering a portion of the indentation to further circumscribe a projection or movable member being held by the holder.

Moreover, it is to be understood that the holders and ramp are configured to be complementary locking structures that cooperate with locking structures on the nozzle tip. Therefore, other embodiments and arrangement of locking structures on the nozzle tip will necessitate corresponding embodiments and arrangements of locking structures on the nozzle body and vice versa.

Referring now to FIGS. 19 to 26, the embodiment of the nozzle tip 300 shown in FIGS. 1 to 8 will now be described in greater detail. The nozzle tip 300 has a curved, frustoconical exterior shape with an insertion portion 302 and a nose portion 304. The insertion portion includes two retaining protrusions 306, 308 that extend outward from the insertion portion 302 and are spaced apart 180 degrees around the outer circumference of the insertion portion 302. The insertion portion also includes two circumferential grooves 310, 312 for receiving O-rings 130. The insertion portion 302 defines nozzle tip entrance 313.

The nose portion 304 extends from the insertion portion 302 and defines outlet 120. A movable member 307 extends from the outer surface of the nose portion 304. In the embodiment shown, the movable member is configured as a resilient, L-shaped tab with a vertical section 309 that extends from the nose portion 304 and a horizontal section 310 that extends from a distal end of the vertical section 309 away from the insertion portion 302.

Vertical section 309 is curved along its length towards the insertion portion 302 and has a rounded corner with the horizontal section 310. The curvature of the vertical section 309 provides additional flexion so a user may flex the vertical section 309 in a direction away from the insertion portion 302. A lip 311 runs widthwise along the end of the horizontal section 310. The lip 311 may provide improved grip and handling ability.

The nozzle tip 300 has longitudinal ribs 312 running along its length to provide additional strength and structures for a user to grip. On the nose portion 304, a rib 314 runs longitudinally from adjacent outlet 120 to just before the tab 307. The rib 314 includes a peak portion 316. A short, transverse rib 318 extends from the nose portion 304 and is connected at a right angle to the distal end of the rib 314. The height of the transverse rib 318 and peak portion 316 are substantially the same and their ends provide a stop for the horizontal section 310 as the tab 307 is flexed back away from the insertion portion 302 and downwards.

A circular, circumferential rib 320 extends substantially concentrically around the nose portion 302. The circumferential rib 320 provides additional strength and a further structure for the user to grip and handle.

A circular washer-like ring 321 extends circumferentially around the nozzle tip 300 between the insertion portion 302 and the nose portion 304.

To connect the nozzle tip 300 to the nozzle body 200, the insertion portion 302 is first inserted and received in the socket 212. Specifically, the insertion portion 302 is moved in a longitudinal direction into the socket 212 until it reaches an inserted position where the tip passageway 126 meets the body passageway 122.

Moreover, for the insertion portion 302 to be inserted into the socket 212, the retaining protrusions 306 and 308 are aligned with the longitudinal sections 221 and 225, respectively. The width and depth of the longitudinal sections 221, 225 are complementary to the width and height of protrusions 306, 308. Similarly, the length of the longitudinal sections 221, 225 are sized to be as long as the travel distance of the insertion portion 302 into the socket 212 to reach the inserted position. Thus, the engagement of the protrusions 306, 308 with their respective longitudinal sections 221, 225 also provides an alignment and guiding function, ensuring that the nozzle tip 300 is inserted in the correct orientation.

As the insertion portion 302 is inserted into the socket 212, the longitudinal ribs 312 on the insertion portion 302 also act as guides. The longitudinal ribs 312 are also sized to extend between the exterior surface of the insertion portion and the interior surface 215 of the socket 212.

In the inserted position, the circumferential ring 321 is received in the gap formed by the differences in diameter between the concentric socket opening 213 and circular rib 233. This engagement further provides stability to the nozzle tip 300 in the event of movement transverse to the longitudinal direction 201.

Moreover, in the inserted position, the tab 307 extends into and is received by the holder 232.

Other embodiments are also possible. The insertion portion and socket may have other complementary shapes and/or cross-section, such as oval, rectangular, etc. In these other embodiments, the internal passageway may continue to have a circular cross-section or not. As noted above, in embodiments where the nozzle body and nozzle tip are configured to engage or mate in a different manner, the steps taken by a user to connect the nozzle tip with the nozzle body may also differ and be dictated by the configuration of the engagement structures.

For example, in some embodiments, there may be a threaded connection between the nozzle tip and nozzle body, e.g. with the male threads on the nozzle tip and the female threads on the nozzle body. In such embodiments, rather than or in addition to being slid longitudinally into the socket, the nozzle tip would be threaded and rotated into the nozzle body. The nozzle tip and nozzle body could then be configured such that the lock is engaged with the final partial rotation of the nozzle tip as it is threaded into the socket.

From the unlocked, inserted position, the nozzle tip 300 is rotatable clockwise into the locked position. In the embodiment shown, the nozzle tip 300 is rotatable around its longitudinal axis, which is parallel to the longitudinal direction 201. In so doing, the retaining protrusions 306 and 308 travel in the circumferential sections 223 and 227, respectively. The retaining protrusions 306, 308 pass through the constriction formed by nubs 229, 231.

Because ramped protrusion 242 is in the path of tab 307 as the nozzle tip 300 is rotated, the ramped protrusion 242 acts as a cam, flexing tab 307 back away from the nozzle body 200. Once the ramped protrusion 242 has been cleared, the tab 307 flexes back into the second holder 234. The nozzle tip 300 has now reached the locked position. Thus, in the embodiment shown, ramped protrusion 242, the tab 307 and holder 234 together form the lock 105.

At least the lock 105 prevents removal of the nozzle tip 300 from the nozzle body 200 as it prevents rotation of the nozzle tip 300 back to the unlocked position. In addition, in the embodiment shown, the cooperating retaining structures of the retaining protrusions 306, 308 and circumferential sections 223, 227 also help retain the nozzle tip 300 in place by preventing movement of the nozzle tip 300 longitudinally out of the socket 212.

Moreover, the nubs 229, 231 act as a secondary lock or locking mechanism to the lock 105. If, for example, the lock 105 were to be released prematurely or unintentionally or were to otherwise fail, the constriction formed by nubs 229, 231 would aid in resisting rotation of the nozzle tip 300 out of the locked position.

In other embodiments, the nozzle 100 might be configured differently. For example, the cooperating retaining structures may not be present and the lock may be the only structure that prevents removal of the nozzle tip from the nozzle body, for example by being made of an aperture through the wall of the nozzle body that receives a protrusion extending from the nozzle tip.

Furthermore, the lock may be configured differently while still being structured and arranged to be engaged by rotating the nozzle tip relative to the nozzle body or by rotating the nozzle tip about a longitudinal axis of the nozzle tip. For example, in some embodiments, the tab may be arranged on the nozzle body and the holder on the nozzle tip.

In yet other embodiments, a spring loaded or detent mechanism might be employed as the lock, where the detent engages once the nozzle tip is sufficiently engaged with the nozzle body.

Similarly, the secondary locking mechanism may be configured differently. Instead of nubs, other structural features may be employed in the grooves to keep the retaining protrusions in place and resist rotation of the nozzle tip. More generally, other secondary locking mechanisms that do not involve nubs or protrusions in the grooves may be employed. For example, in addition to the lock accessible from the exterior of the nozzle, an additional locking mechanism using detents or other features may be provided at other interfaces between the nozzle tip and nozzle body.

A secondary lock or locking mechanism may also result from a structural arrangement that requires a user to first move the nozzle tip into a position from which the movable member can be actuated to release the primary lock. Conversely, the secondary lock may be configured such that even after the movable member of the primary lock is actuated, an additional member or other components must be actuated to release the secondary lock.

In the embodiment shown, to release the lock, a user flexes back the tab 307 to disengage from the second holder 232 and clear the height of the ramped protrusion 242. Rotating the nozzle tip counter clockwise to the unlocked, inserted position and pulling out the nozzle tip 300 allows the nozzle to be disengaged and disconnected from the nozzle body 200.

The member movable to release the lock is accessible to a user from an exterior of the nozzle. For example, in the embodiment shown, the tab 307 is arranged and accessible from an exterior of the nozzle. Specifically, the tab 307 is accessible on a side of the support portion 208 opposite the connection portion 202.

However, other embodiments are also possible. For example, the connection portion 202 might protrude sideways out of the nozzle body, forming an approximately 90 degree bend with the nozzle body. The support portion might then be at one extreme end of the nozzle body such that the movable member and the lock are arranged and accessible on the same side of the support portion as the connection portion.

More generally, in embodiments described above where the releasable lock is configured differently, for example with a protrusion on the nozzle body being inserted into the nozzle tip, a movable member to release the lock would still be configured to be accessible from an exterior of the nozzle.

The above disclosure describes a nozzle with a removable nozzle tip. Other aspects of the present disclosure, such as those described below, may be present in a nozzle with a removable tip, a nozzle without a removable tip or even a single-piece nozzle. This could include a nozzle that has been integrally formed from a single piece or one where multiple pieces have been permanently connected together and assembled to form the nozzle.

In another aspect of the present disclosure, there is provided a nozzle for use in a water slide feature that includes a nozzle inlet, a nozzle outlet, and a passageway wall with an interior surface defining a passageway for the water to flow from the nozzle inlet to the nozzle outlet. In a tip portion of the nozzle, the interior surface extends circumferentially around a central axis and includes first, second and third curved portions.

Embodiments will now be described in more detail. Specifically, as best shown in FIGS. 25 and 26, in a tip portion 127 of the nozzle 100, the tip interior surface 128 extends circumferentially around a central axis 322 and, at any given point along the tip interior surface 128, a tangent 323 to the tip interior surface 128 forms an angle θ with the central axis 322.

The tip interior surface 128 includes a first curved portion 324 with a first radius of curvature $R_1$. The angle θ between the tip interior surface 128 and the central axis 322 increases along the first curved portion 324 in the flow direction 116. Thus, the first curved portion 324 could be considered concave when viewed from the central axis 322. The first curved portion begins with a diameter $D_1$, which shortens along the first curved portion 324 in the flow direction 116.

Immediately following and downstream of the first curved portion 324, the tip interior surface 128 includes a second curved portion 326 with a second radius of curvature $R_2$. The angle θ between the tip interior surface 128 and the central axis 322 increases along the second curved portion 326 as well, but at a higher rate than for the first curved portion 324. In that sense, the second curved portion 326 may be described as more concave than the first curved portion 324 as seen from the central axis 322.

Immediately following and downstream of the second curved portion 326, the tip interior surface 128 includes a third curved portion 328. The angle θ between the tip interior surface 128 and the central axis 322 decreases along the third curved portion 328 in the flow direction 116. In that sense, the third curved portion 328 may be described as convex as viewed from the central axis 322 and as compared to the concave first and second curved portions 324, 326. In the illustrated embodiment, the third curved portion 328 extends until the outlet 120.

The presence, order and/or radii of curvature of the first, second and third curved portions 324, 326, 328 may aid in reducing turbulence and pressure losses of water flowing through the nozzle 100 as compared, for example, to some embodiments where one or more of the curved portions are not present. Similarly, the presence, order and/or radii of curvature of the first, second and third curved portions 324, 326, 328 may increase laminar flow of liquid flowing through the nozzle. This may allow for the nozzle 100 according to the present disclosure to provide a jet of liquid, such as water, with a predetermined and desired force output more energy efficiently than embodiments of nozzles with other internal geometries, such as embodiments of nozzles where there exists a sudden step change (narrowing or widening) in the diameter of the passageway.

Various relative dimensions of the first, second and third radii of curvature may be possible. In general, the first radius of curvature may be 8 to 10 times larger than the second radius of curvature, more specifically about 9.4 times larger. In turn, the second radius of curvature may be 1.0 to 1.2 times larger than the third radius of curvature, more specifically about 1.1 times larger.

The first radius of curvature may also be defined in relation to the outlet diameter $D_o$ of the nozzle outlet 120. The first radius of curvature may be 35 to 45 times larger than the outlet diameter, more specifically about 41 times larger. The second radius of curvature may be 4 to 5 times larger than the outlet diameter $D_o$, more specifically about 4.4 times larger. The third radius of curvature may be 3.5 to 4.5 times larger than the outlet diameter $D_o$, more specifically about 3.9 times larger.

The following table provides values for one example embodiment of the geometry.

| Dimension | Value (mm) |
|---|---|
| Diameter at start of first curved portion ($D_1$) | 29 |
| First radius of curvature ($R_1$) | 414 |
| Second radius of curvature ($R_2$) | 44 |
| Third radius of curvature ($R_3$) | 39 |
| Outlet diameter ($D_o$) | 10 |

Other embodiments are also possible. For example, in the embodiment shown, the third curved portion 326 extends to the nozzle outlet 120. In some embodiments, the tip interior surface 128 includes a frusto-conical portion with a straight taper immediately downstream of the third curved portion, the frusto-conical portion tapering towards and until the nozzle outlet 120. Similarly, in some embodiments, one or more of the curvatures, particularly the first curved portion, may be replaced with straight tapers in the shape of a frusto-cone or straight sections without any taper.

While different possible geometries have been described, other geometries are possible. In particular, the two-part nozzle described herein does not necessarily have the internal geometry described above.

Moreover, the desired internal geometry of the nozzle depends in part on the supply pressure and velocity of the liquid being sprayed, as well as the desired output velocity and pressure. In general, the first, second, and third curved portions are structured and arranged to reduce turbulent flow of the liquid, such as water, as the liquid flows through the tip section, to increase laminar flow of the liquid as the liquid flows through the tip section, and to reduce pressure loss as the liquid flows through the tip section.

Additional curved portions as part of the internal geometry may provide additional efficiency gains. Referring again to FIGS. 16 and 18, adjacent to the inlet 118, the thickness T of the wall 110 tapers towards the nozzle inlet 118. Specifically, the body interior surface 124 has a fourth curved, convex portion 244 with a fourth radius of curvature $R_4$ that results in an expansion of the passageway 114.

As such, fluid entering the inlet 118 from a hose or other fluid supply conduit encounters less of a sudden reduction in diameter caused by the thickness T. The fourth curved portion 244 facilitates a smooth, continuous transition to the diameter of the passageway 114. This tapering and/or fourth curved portion 244 may further improve efficiencies and reduce pressure losses in the fluid.

Figure 30A:
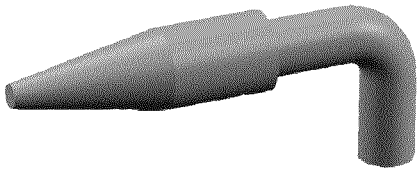
FIGS. 30A to 30J are representations of alternative geometries for the interior surface of the nozzle.
Figure 30B:
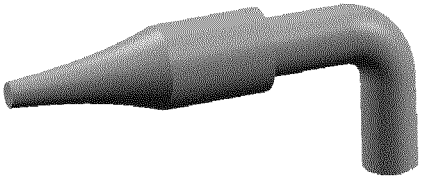
Figure 30C:
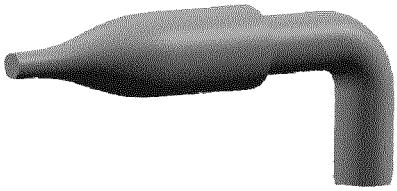
Figure 30D:
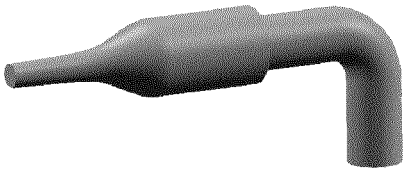
Figure 30E:
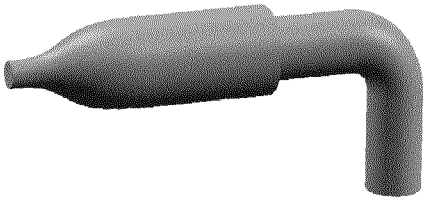
Figure 30F:
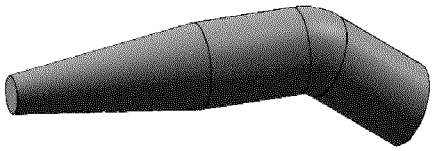
Figure 30G:
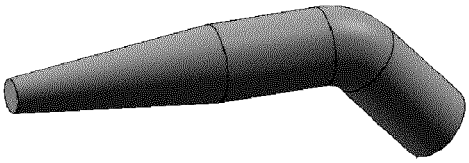
Figure 30H:
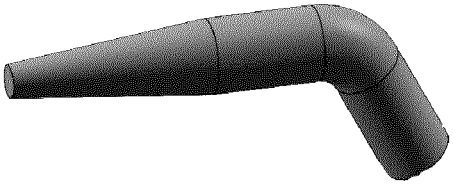
Figure 30I:
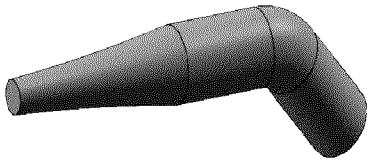
Figure 30J:
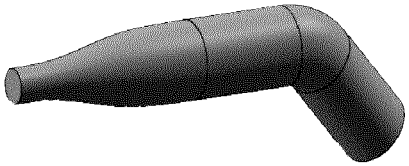

Referring to FIGS. 30A to 30J, other possible nozzle geometries are shown as three-dimensional representations of the passageway:

- FIG. 30A shows a 90 degree bend leading to a step-change expansion into a cylindrical passageway followed by a straight frusto-conical portion
- FIG. 30B shows a 90 degree bend leading to a step-change expansion into a cylindrical passageway followed by a convex portion
- FIG. 30C shows a 90 degree bend leading to a step-change expansion into a cylindrical passageway followed by a concave portion transitioning into a convex portion
- FIG. 30D shows a 90 degree bend leading to a step-change expansion into a cylindrical passageway followed by a concave portion transitioning to an elongated convex portion as compared to FIG. 30C
- FIG. 30E shows a 90 degree bend leading to a step-change expansion into a cylindrical passageway followed by a concave portion transitioning to a shortened convex portion as compared to FIG. 30C
- FIG. 30F shows a 30 degree bend leading to a cylindrical portion followed by a frusto-conical portion
- FIG. 30G shows a 45 degree bend leading to a cylindrical portion followed by a frusto-conical portion
- FIG. 30H shows a 60 degree bend leading to a cylindrical portion followed by a frusto-conical portion
- FIG. 30I shows a 45 degree bend leading to a cylindrical portion followed by a convex tip portion
- FIG. 30J shows a 45 degree bend leading to a cylindrical portion followed by a concave portion transitioning into a convex tip portion As in the embodiment shown, the first, second and third curved portions 322, 324, 326 may be located in the nozzle tip 300 and are therefore removable from the nozzle body 200 and, in particular, the connection portion 202. This may aid installation and start-up of the nozzle where dirt accumulated in the fluid supply hose or conduit is forced through the system and gets caught in the nozzle tip due to the narrowing of the passageway 114. As such, despite the nozzle body 200 being firmly affixed to a support structure, the nozzle tip 300 may be removed and cleaned out. This avoids the need to have to disconnect the fluid supply conduit and/or disconnect the nozzle from the support structure to service the nozzle and, in particular, the nozzle tip. However, as noted above, it will be understood that the aspects of the present disclosure are not necessarily combined in all embodiments.

The nozzle 100 as described herein may be used in a variety of applications, including water amusement attractions and, more specifically, water slide features such as those disclosed in PCT international applications PCT/CA2013/050794, PCT/CA2015/050339, and PCT/CA2016/050838, which are hereby incorporated herein by reference in their entireties.

Accordingly, in yet another aspect of the present disclosure there is provided a water amusement attraction including a water slide feature having a channel with a sliding surface for a rider or a ride vehicle to slide on. In some embodiments, the channel has walls that define openings. One or more nozzles, for example one or more nozzles according to embodiments described herein, are positioned to spray fluid, such as water, into the channel to affect motion of the rider or ride vehicle.

In embodiments where the channel has walls with openings for the nozzles, at least one nozzle may extend through a corresponding one of the openings with the nozzle body being affixed to the wall. The nozzle is angled to spray water over the sliding surface.

Figure 27:
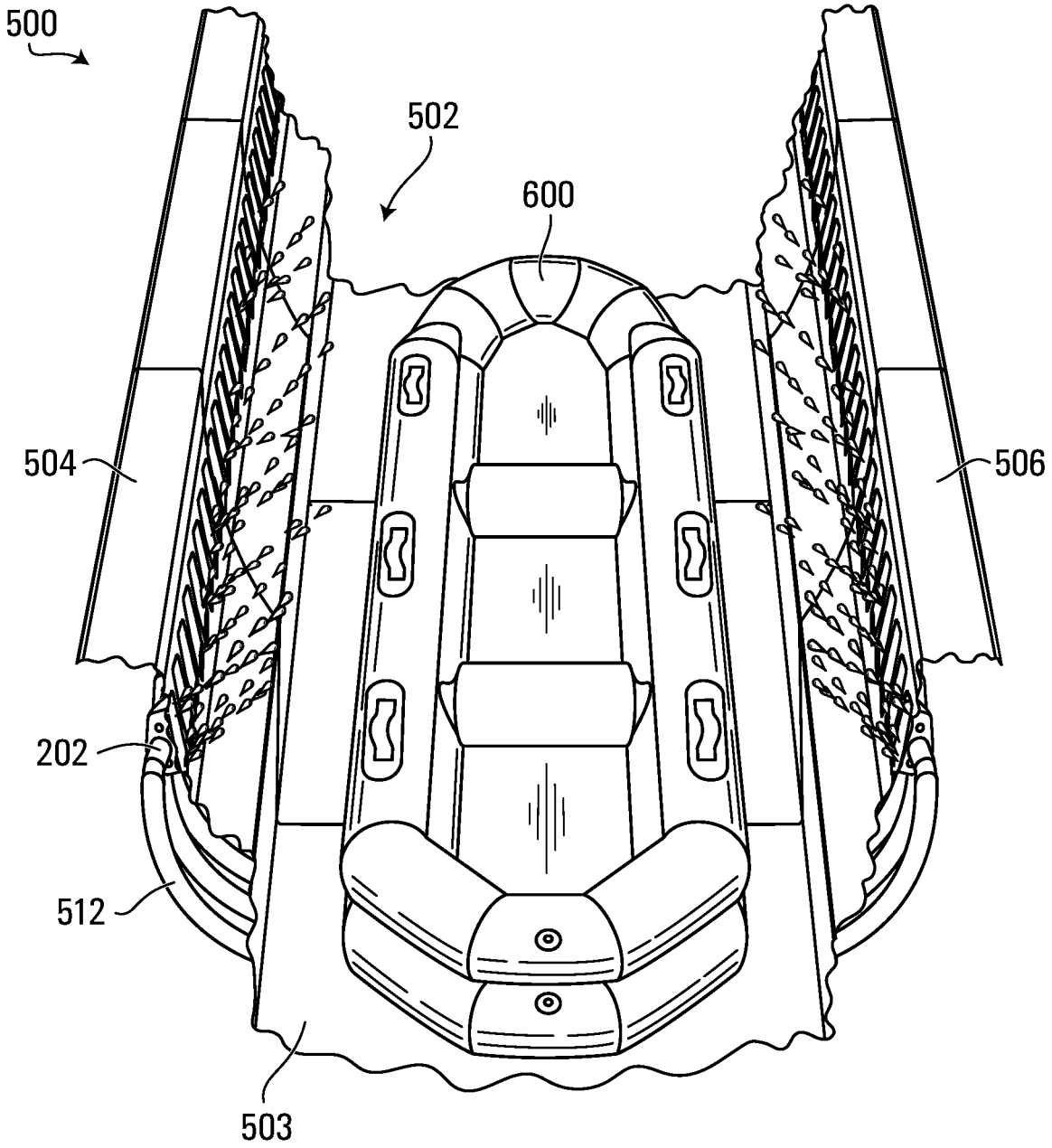
FIG. 27 is a partial view of one embodiment of a channel in a water slide feature.
Figure 28:
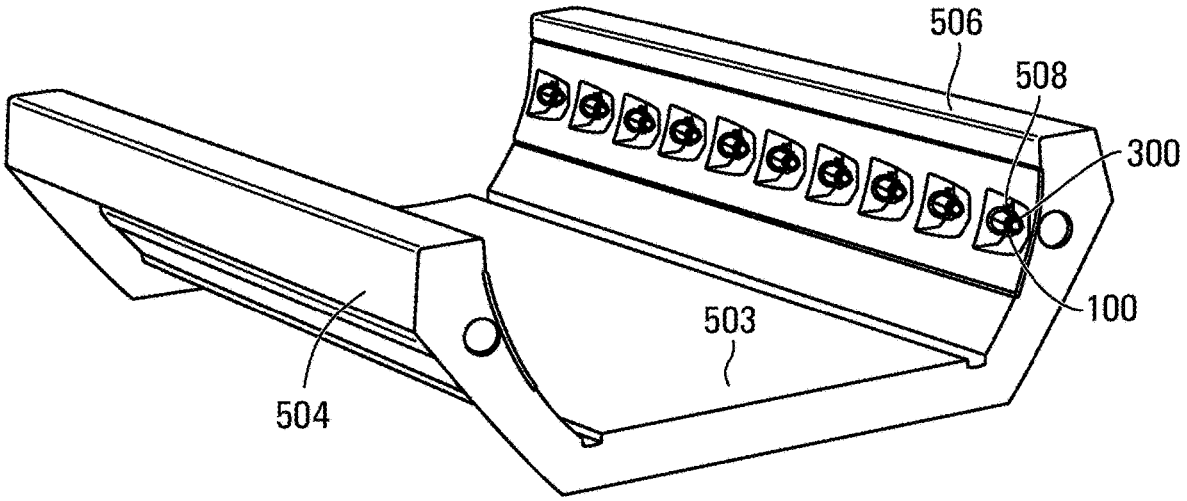
FIG. 28 is perspective view of a portion of the channel thereof.
Figure 29:
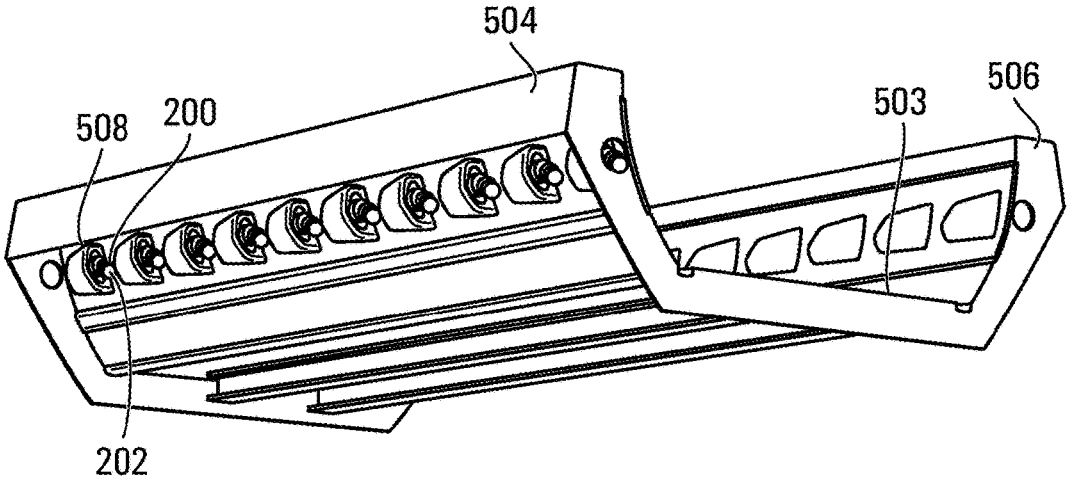
FIG. 29 is a further perspective view of a portion the channel thereof.

Referring to FIGS. 27 to 29, embodiments of a water slide feature will be described. A water slide feature 500 includes a channel 502 having a sliding surface 503 and walls 504, 506 positioned on each side of the channel 502. The sliding surface 503 may be lubricated with water to facilitate sliding thereon.

A ride vehicle 600 is positioned in the channel on the sliding surface 503. The ride vehicle shown in FIG. 27 is only exemplary and many embodiments of the ride vehicle are possible.

The walls 504, 506 define openings 508. At least one nozzle 100 extends through a corresponding one of the openings. The nozzle body 200, in particular the support portion 208, is affixed to the walls 504, 506, which act as a support structure of the water slide feature. The connection portion 202 extends into an exterior of the channel 502.

In other embodiments, such as embodiments where the nozzle does not extend through openings in the walls of the channel, support portion 208 may be affixed to a different support structure of the water slide feature. For example, the one or more nozzles may be positioned to extend or spray into the channel through openings in the sliding surface 503. In such embodiments, the support portion 208 may be affixed to a support structure of the water slide feature beneath the sliding surface 503.

In yet other embodiments, the support portion 208 may not be present and the nozzle may be affixed to a support structure of the water slide feature or some other component with other connecting structure, such as a clamp or bracket.

A hose 512 extends from a manifold (not shown) below the channel 502 to the connection portion 202 of the nozzle 100 and supplies water. The nozzle tip 300 extends into the direction of the channel and is positioned to spray water into the channel 502 to affect motion of the ride vehicle 600.

In embodiments where the nozzle 100 is configured with a removable nozzle tip 300, the nozzle tip 300 is removable from inside the channel while the nozzle body 200 remains affixed to the supporting structure of the water slide feature, such as the walls 504, 506 in the illustrated embodiment. This may simplify servicing of the water slide feature. For example, replacement of worn nozzle tips may not necessarily require removal of the nozzle bodies, nor access to the exterior of the channel 502. Moreover, it is to be understood that removable from inside the channel means that a user may be located in the channel and successfully remove the nozzle tip from the nozzle body but not necessarily that the nozzle tip or lock extend into the channel.

The nozzle disclosed herein may be operated under a variety of operating parameters in a variety of environments. In one embodiment of the water slide feature described herein, the nozzles may be supplied with a flow rate of 26 US gallons per minute at a pressure of 25 psi.

The nozzle disclosed herein may be manufactured in a variety of known ways. For example, one or more portions of the nozzle 100 may be injection moulded, structural foam moulded and/or machined. The presence of one or more of the above described features, such as the ribs 312, may further aid in one or more manufacturing methods, such as injection moulding.

Lastly, any methods related to the nozzles, for example methods of use, such as a method of inserting and locking the nozzle tip to the nozzle body, are also within the scope of the present disclosure.

We claim:

1. A water slide feature comprising:

a channel having a sliding surface for a rider or a ride vehicle to slide on, and one or more nozzles positioned to spray fluid into the channel to affect motion of the rider or ride vehicle, at least one of the one or more nozzles comprising:

a nozzle body including a connection portion for connecting to a fluid supply of the fluid and a support portion for affixing to a support structure of the water slide feature; and a nozzle tip removably connected to the nozzle body, the nozzle tip being prevented from being removed from the nozzle body by at least a releasable lock, wherein the lock comprises a member movable to release the lock, the member being accessible to a user from an exterior of the nozzle;

wherein the nozzle body further comprises an engagement portion with a socket for receiving the nozzle tip;

wherein the nozzle tip comprises an insertion portion sized to mate with the socket and a nose portion that protrudes from the nozzle body;

wherein the insertion portion is rotatable within the socket;

wherein the insertion portion is rotatable within the socket between an unlocked position and a locked position; and wherein the member protrudes from the nose portion, wherein, in the unlocked position, the member is received in a first holder formed in the nozzle body; and wherein, in the locked position, the member is received in a second holder formed in the nozzle body.

2. The water slide feature of claim 1, wherein the lock is structured and arranged to be engaged by rotating the nozzle tip relative to the nozzle body.

3. The water slide feature of claim 1, wherein the lock is structured and arranged to be engaged by rotating the nozzle tip about a longitudinal axis of the nozzle tip.

4. The water slide feature of claim 1, wherein the member comprises a resilient tab extending from one of the nozzle tip and the nozzle body.

5. The water slide feature of claim 4, wherein the tab is received in a corresponding holder on the other one of the nozzle tip and the nozzle body.

6. The water slide feature of claim 5, wherein the lock is releasable by flexing the tab out of the holder.

7. The water slide feature of claim 1, wherein the member is arranged and accessible on a side of the support portion opposite the connection portion.

8. The water slide feature of claim 1, wherein the nozzle tip includes a retaining protrusion that protrudes from the insertion portion and is received in a corresponding groove in the socket.

9. The water slide feature of claim 8, wherein the groove comprises a longitudinal section and a circumferential section.

10. The water slide feature of claim 9, wherein the circumferential section includes a constriction that the protrusion passes through when the nozzle tip is rotated within the socket from an unlocked position to the locked position.

11. The water slide feature of claim 1, wherein the lock is a primary lock and the nozzle further comprises a secondary locking structure that resists removal of the nozzle tip.

12. The water slide feature of claim 11, wherein the secondary lock comprises an interference between complementary structures on the nozzle tip and nozzle body.

13. The water slide feature of claim 11, wherein the secondary lock comprises a protrusion extending from one of the nozzle tip and the nozzle body being received in a corresponding groove or aperture in the other one of the nozzle tip and nozzle body.

14. The water slide feature of claim 13, wherein the groove or aperture comprises a constriction sized to interfere with movement of the protrusion along the groove or aperture.

15. The water slide feature of claim 1, wherein the nozzle tip and nozzle body include complementary retaining structures that cooperate to resist longitudinal movement of the nozzle tip relative to the nozzle body.

16. The water slide feature of claim 15, wherein the complementary retaining structures comprise a protrusion from one of the nozzle tip and the nozzle body and a corresponding groove, recess or aperture in the other one of the nozzle tip and the nozzle body.

17. The water slide feature of claim 1, wherein the channel includes walls, the walls defining a plurality of openings, wherein the nozzle body extends through a corresponding one of the openings and is affixed to the walls, and the nozzle tip is connected to the nozzle body and positioned to spray water into the channel.

18. The water slide feature of claim 1, wherein the nozzle tip is removable from inside the channel.

19. A water slide feature comprising:

a channel having a sliding surface for a rider or a ride vehicle to slide on, and one or more nozzles positioned to spray water into the channel to affect motion of the rider or ride vehicle, at least one of the one or more nozzles comprising:

a nozzle inlet;

a nozzle outlet; and a passageway wall with an interior surface defining a passageway for the water to flow from the nozzle inlet to the nozzle outlet, wherein, in a tip portion of the nozzle, the interior surface extends circumferentially around a central axis and comprises:

a first curved portion with a first radius of curvature, an angle between the interior surface and the central axis increasing along the first curved portion, a second curved portion with a second radius of curvature, the second curved portion being immediately downstream of the first curved portion, the angle between the interior surface and the central axis increasing along the second curved portion, and a third curved portion with a third radius of curvature, the third curved portion being immediately downstream of the second curved portion, the angle between the interior surface and the central axis decreasing along the second curved portion.

20. The water slide feature of claim 19, wherein the interior surface further comprises a frusto-conical portion immediately downstream of the third curved portion, in which the interior surface tapers towards and until the nozzle outlet.

21. The water slide feature of claim 19, wherein the third curved portion extends until the nozzle outlet.

22. The water slide feature of claim 19, wherein the first radius of curvature is 8 to 10 times larger than the second radius of curvature.

23. The water slide feature of claim 19, wherein the second radius of curvature is 1.1 to 1.2 times larger than the third radius of curvature.

24. The water slide feature of claim 19, wherein the nozzle outlet has an outlet diameter and the first radius of curvature is 35 to 45 times larger than the outlet diameter.

25. The water slide feature of claim 19, wherein the nozzle outlet has an outlet diameter and the second radius of curvature is 4 to 5 times larger than the outlet diameter.

26. The water slide feature of claim 19, wherein the nozzle outlet has an outlet diameter and the third radius of curvature is 3.5 to 4.5 times larger than the outlet diameter.

27. The water slide feature of claim 19, wherein upstream of the first curved portion the passageway includes an elbow.

28. The water slide feature of claim 27, wherein the elbow is between 1 and 90 degrees, inclusive.

29. The water slide feature of claim 28, wherein the elbow is 30 degrees.

30. The water slide feature of claim 19, wherein the passageway wall has a thickness and the thickness tapers towards the nozzle inlet adjacent to the nozzle inlet.

31. The water slide feature of claim 19, wherein adjacent to the nozzle inlet the interior surface comprises a fourth curved portion resulting in an expansion of the passageway.

32. The water slide feature of claim 19, wherein the nozzle is comprised of a nozzle tip and a nozzle body, the nozzle tip being removable from the nozzle body and the tip portion being located in the nozzle tip.

33. The water slide feature of claim 19, wherein the first, second, and third curved portions are structured and arranged to reduce turbulent flow of the water as the water flows through the tip portion.

34. The water slide feature of claim 19, wherein the first, second, and third curved portions are structured and arranged to increase laminar flow of the water as the water flows through the tip portion.

35. The water slide feature of claim 19, wherein the first, second, and third curved portions are structured and arranged to reduce pressure loss as the water flows through the tip portion.

36. The water slide feature of claim 35, wherein the channel includes walls, the walls defining a plurality of openings, wherein the nozzle extends through a corresponding one of the openings and is positioned to spray water into the channel.

37. The water slide feature of claim 19, wherein the nozzle is comprised of a nozzle tip and a nozzle body, the nozzle tip being removable from the nozzle body and the tip portion being located in the nozzle tip.

38. The water slide feature of claim 37, wherein the nozzle tip is removable from inside the channel.

39. A water slide feature comprising:

a channel having a sliding surface for a rider or a ride vehicle to slide on, and one or more nozzles positioned to spray fluid into the channel to affect motion of the rider or ride vehicle, at least one of the one or more nozzles comprising:

a nozzle body including a connection portion for connecting to a fluid supply of the fluid and a support portion for affixing to a support structure of the water slide feature; and a nozzle tip removably connected to the nozzle body, the nozzle tip being prevented from being removed from the nozzle body by at least a releasable lock, wherein the lock comprises a member movable to release the lock, the member being accessible to a user from an exterior of the nozzle;

wherein the nozzle body further comprises an engagement portion with a socket for receiving the nozzle tip;

wherein the nozzle tip comprises an insertion portion sized to mate with the socket and a nose portion that protrudes from the nozzle body;

wherein the insertion portion is rotatable within the socket;

wherein the insertion portion is rotatable within the socket between an unlocked position and a locked position;

wherein the member protrudes from the nose portion, wherein, in the unlocked position, the member is received in a first holder formed in the nozzle body; and wherein, in the locked position, the member is received in a second holder formed in the nozzle body; and wherein a ramped protrusion extends from the nozzle body between the first and second holders in a path of the member as the nozzle tip rotates from the unlocked position to the locked position.

* * * * *